US007798787B2

(12) United States Patent
Matumoto et al.

(10) Patent No.: US 7,798,787 B2
(45) Date of Patent: Sep. 21, 2010

(54) INTERNAL INTERMEDIATE PRESSURE MULTISTAGE COMPRESSION TYPE ROTARY COMPRESSOR, MANUFACTURING METHOD THEREOF AND DISPLACEMENT RATIO SETTING METHOD

(75) Inventors: Kenzo Matumoto, Ora-Gun (JP); Haruhisa Yamasaki, Ora-Gun (JP); Kazuya Sato, Ora-Gun (JP); Masaya Tadano, Nitta-Gun (JP); Satoshi Imai, Ota (JP); Akira Sugawara, Kumagaya (JP); Takashi Sato, Kumagaya (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 784 days.

(21) Appl. No.: 11/434,914

(22) Filed: May 17, 2006

(65) Prior Publication Data

US 2006/0204377 A1 Sep. 14, 2006

Related U.S. Application Data

(63) Continuation of application No. 10/454,636, filed on Jun. 5, 2003, now Pat. No. 7,131,821.

(30) Foreign Application Priority Data

| | | |
|---|---|---|
| Jun. 5, 2002 | (JP) | 2002-164735 |
| Jun. 7, 2002 | (JP) | 2002-166410 |
| Jun. 7, 2002 | (JP) | 2002-167253 |
| Jun. 7, 2002 | (JP) | 2002-167271 |
| Jun. 18, 2002 | (JP) | 2002-176494 |
| Jun. 19, 2002 | (JP) | 2002-177941 |
| Jun. 26, 2002 | (JP) | 2002-185802 |

(51) Int. Cl.
*F04B 25/00* (2006.01)
*F04B 17/03* (2006.01)

(52) U.S. Cl. ..... 417/244; 417/366; 417/410.3

(58) Field of Classification Search ..... 417/243, 417/244, 366, 410.3, 902; 184/6.16
See application file for complete search history.

(56) References Cited

U.S. PATENT DOCUMENTS 3,922,114 A 11/1975 Hamilton et al. ..... 218/366

(Continued)

FOREIGN PATENT DOCUMENTS

EP 1 195 526 A1 4/2002

(Continued)

OTHER PUBLICATIONS

Partial European Search Report dated Nov. 25, 2003.

*Primary Examiner*—Devon C Kramer
*Assistant Examiner*—Christopher Bobish
(74) *Attorney, Agent, or Firm*—Kratz, Quintos & Hanson, LLP

(57) ABSTRACT

There is provided an internal intermediate pressure multistage compression type rotary compressor capable of reducing a height dimension while reducing the amount of oil to be discharged outside. An electric element and first and second rotary compression elements which are driven by a rotary shaft of the electric element disposed under the electric element are provided in a hermetic shell case. There is provided a refrigerant introduction pipe for introducing refrigerant in the hermetic shell case over the electric element into the second rotary compression element through an outside of the hermetic shell case. There is provided an oil path provided in the rotary shaft for discharging oil through an oil discharge port which is positioned at the upper end of the rotary shaft. The refrigerant introduction pipe is provided such that apart of an inlet of the refrigerant introduction pipe is positioned under the upper end of a stator of the electric element.

2 Claims, 18 Drawing Sheets

U.S. PATENT DOCUMENTS

| | | | | |
|---|---|---|---|---|
| 5,554,015 | A * | 9/1996 | Dreiman et al. | 417/415 |
| 5,931,650 | A | 8/1999 | Yasu et al. | 418/55.3 |
| 6,000,917 | A | 12/1999 | Smerud et al. | 417/368 |
| 6,390,789 | B1 | 5/2002 | Grob et al. | 417/350 |
| 6,508,636 | B2 * | 1/2003 | Ogawa et al. | 417/410.3 |
| 2001/0001923 | A1 | 5/2001 | Katayama et al. | 62/160 |

FOREIGN PATENT DOCUMENTS

| | | | |
|---|---|---|---|
| EP | 1195526 | A1 * | 4/2002 |
| JP | 2-294587 | | 12/1990 |
| JP | 4-128585 | | 4/1992 |
| JP | 2000-283077 | | 10/2000 |

* cited by examiner

INTERNAL INTERMEDIATE PRESSURE MULTISTAGE COMPRESSION TYPE ROTARY COMPRESSOR, MANUFACTURING METHOD THEREOF AND DISPLACEMENT RATIO SETTING METHOD

CROSS-REFERENCE TO RELATED APPLICATION

This application is a divisional application of U.S. Ser. No. 10/454,636, filed on Jun. 5, 2003 now U.S. Pat. No. 7,131,821, the entire contents of which is incorporated herein by reference.

FIELD OF THE INVENTION

The invention relates to an internal intermediate pressure type multistage rotary compressor comprising an electric element in a hermetic shell case, and first and second rotary compression elements being positioned under the electric element and driven by a rotary shaft of the electric element, wherein refrigerant compressed and discharged by said first rotary compression element is discharged into the hermetic shell case, and the thus discharged intermediate pressure refrigerant is sucked in and compressed by the second rotary compression element and discharged into hermetic shell case, and a method of manufacturing method the internal intermediate pressure multistage compression type rotary compressor and a method of setting displacement ratio thereof.

BACKGROUND OF THE INVENTION

A conventional internal intermediate pressure type multistage rotary compressor of this type is, for example, disclosed in Japanese Laid-Open Publication No. 2-294587 (F04C23/00). Such a rotary compressor is provided with an electric element in a hermetic shell case and a rotary compression mechanism which is positioned under the electric element and comprises first and second rotary compression elements which are driven by a rotary shaft of the electric element. When the electric element is actuated to rotate the rotary shaft, refrigerant is sucked into a low pressure chamber of a cylinder through a suction port of the first rotary compression element (first stage) provided under the electric element, and the refrigerant is subjected to compression of first stage by the operation of the roller and a vane and is changed into intermediate pressure refrigerant, which is in turn discharged from a high pressure chamber of a cylinder into the hermetic shell case under the electric element through a discharge port, a noise eliminating chamber, and an intermediate discharge pipe.

Oil is separated from the intermediate pressure refrigerant discharged into the hermetic shell case, and the refrigerant flows into a refrigerant introduction pipe provided under the electric element, and passes through the outside of the electric element, then is sucked into the low pressure chamber of a cylinder 238 through a suction port 261 of the second rotary compression element 234 (second stage) as shown in the left side of FIG. 22, wherein it is subjected to compression of second stage by the operation of the roller 246 and the vane 250, which is in turn changed into high temperature high pressure refrigerant. The high temperature high pressure refrigerant passes through a discharge port 239, a noise eliminating chamber, and is discharged into a refrigeration circuit through the outside of the refrigerant discharge pipe. A cycle of the thus discharged refrigerant is repeated such that the discharged refrigerant flows into a radiator (gas cooler) and the like of the refrigeration circuit, and radiates heats, then it is throttled by an expansion valve and heat thereof is absorbed by an evaporator, and it returns to the first rotary compression element through the refrigerant introduction pipe and is sucked in the first rotary compression element.

In this case, displacement of the second rotary compression element is normally set to be smaller than that of the first rotary compression element.

An oil path is provided in the rotary shaft of such a rotary compressor, and oil stored in the oil reservoir provided at the bottom of the hermetic shell case is pumped up in the oil path by an oil pump (supply means) attached to the lower end of the rotary shaft. The thus pumped up oil is supplied to the rotary shaft and the sliding portions and bearings of the first and second rotary compression elements so as to lubricate therein and seal them, and it is discharged through an oil discharge port provided at the upper end of the rotary shaft so as to cool the electric element in the hermetic shell case and lubricate various sliding portions at the periphery thereof.

In the internal intermediate pressure multistage compression type rotary compressor, the refrigerant compressed by the second rotary compression element is discharged outside as it is. However, the foregoing oil which is supplied to the sliding portions of the second rotary compression element is mixed in the refrigerant, and hence the oil is discharged together with the refrigerant. Accordingly, there arises a problem that a large amount of oil flows in refrigeration circuit of the refrigerating cycle, thereby deteriorating the performance of refrigerating cycle.

Further, with such a rotary compressor, since a pressure (high pressure) in the cylinder of the second rotary compression element is higher than a pressure (intermediate pressure) in the hermetic shell case having the bottom serving as the oil reservoir, it is difficult to supply oil to the second rotary compression element utilizing the difference in these pressures.

Therefore, it is contemplated that the intermediate pressure refrigerant discharged from the first rotary compression element is not discharged into the hermetic shell case, but the high-pressure refrigerant discharged from the second rotary compression element is discharged into the hermetic shell case, thereby rendering the interior of the hermetic shell case to be high pressurized. That is, with such an internal high pressure multistage compression type rotary compressor, the refrigerant is sucked through the suction port of the first rotary compression element in the low pressure chamber of the cylinder, and it is subjected to compression by the operation of the roller and the vane and is changed into the intermediate pressure, which is in turn discharged from the high pressure chamber of the cylinder into the discharge port and the noise eliminating chamber. The refrigerant discharged into the noise eliminating chamber passes through the refrigerant introduction pipe, and it is sucked in the low pressure chamber of the cylinder through the suction port of the second rotary compression element, then it is subjected to compression of second stage by the operation of the roller and vane and is changed into a high temperature high pressure refrigerant, which is in turn discharged from the high pressure chamber into the hermetic shell case through the suction port and the noise eliminating chamber.

Although it is configured that the high pressure refrigerant in the hermetic shell case flows into a radiator through the refrigerant discharge pipe, it is expected that the amount of oil to flow outside can be reduced and the supply of oil to the sliding portions can be easily performed.

With such a multistage compression type rotary compressor, when the refrigerant introduction pipe relative to the second rotary compression element is opened to the space under the electric element, the distance between the first rotary compression element and the intermediate discharge pipe for discharging the refrigerant is short so that oil is not sufficiently separated from the refrigerant, and hence excessive oil is sucked in the second rotary compression element. In such a case, since the amount of oil which is discharged from the second rotary compression element into an external refrigeration circuit through the refrigerant discharge pipe becomes large, the lubricating and sealing performance in the hermetic shell case of the rotary compressor is deteriorated, causing a problem of an adverse affect in the refrigeration circuit by the oil.

If the refrigerant introduction pipe relative to the second rotary compression element is opened to the space over the electric element to solve the foregoing problem, there arises another problem that a height dimension of the compressor is enlarged as a whole. Further, there arises still another problem that the oil discharged from the upper end of the rotary shaft is prone to flow into the refrigerant introduction pipe, to induce inconvenience like the foregoing problems.

SUMMARY OF THE INVENTION

The invention has been developed to solve the conventional technical problems and it is a first object of the invention to provide an internal intermediate pressure multistage compression type rotary compressor capable of reducing a height dimension while reducing the amount of oil to be discharged outside, and of effectively avoiding such an inconvenience that an excessive oil is sucked in the second rotary compression element and discharged outside.

Although the hermetic shell case, the electric element, the rotary compression mechanism or the like constituting the rotary compressor are manufactured by cutting materials of components, welding and the like, there was a case where a foreign matter such as dust, a cut waste or the like remains in the hermetic shell case. Further, if the rotary compressor is connected to an external refrigerant pipe, there is a likelihood that a similar foreign matter in the refrigeration circuit is sucked in the refrigerant pipe.

With such a multistage compression type rotary compressor, since the intermediate pressure refrigerant which is discharged into the hermetic shell case from the first stage (first rotary compression element) is introduced into the second stage (second rotary compression element) through the refrigerant introduction pipe which is directly connected to the hermetic shell case, if a foreign matter such as dust, a cut waste or the like is present in the hermetic shell case, the foreign matter is sucked in the second stage together with the refrigerant through the refrigerant introduction pipe, involving in the risk of the abrasion in the second rotary compression element and the locking in the second rotary compression element in the worst case.

The invention has been developed to solve such conventional technical problems, and it is a second object of the invention to provide a multistage compression type rotary compressor to solve the problems of the occurrence of abrasion and locking in the second rotary compression element by eliminating the foreign matter in the rotary compressor.

With such a multistage compression type rotary compressor, although the refrigerant which is compressed by the second rotary compression element is discharged outside as it is, the oil supplied to the sliding portions of the second rotary compression element is mixed in the refrigerant, so that the oil is discharged together with the refrigerant. Accordingly, there arises a problem that a large amount of oil flows into the refrigeration circuit in the refrigerating cycle, thereby deteriorating the performance of refrigerating cycle.

Further, with such an internal intermediate pressure multistage compression type rotary compressor, since a pressure (high-pressure) inside the cylinder of the second rotary compression element is higher than that (intermediate pressure) inside the hermetic shell case having the bottom serving as the oil reservoir, it was difficult to supply oil to the second rotary compression element utilizing the difference in pressure.

The invention has been developed to solve such technical problems, and it is a third object of the invention to provide a multistage compression type rotary compressor capable of reducing the amount of oil which is discharged into the outside of the compressor, and of supplying oil to the second rotary compression element smoothly without fail.

Still further, a vane attached to the multistage compression type rotary compressor is movably inserted into grooves provided in the radial direction of the cylinder. Such a vane is pressed by a roller to partition the interior of the cylinder into a low pressure chamber and a high pressure chamber, wherein there are provided at the back side of the vane a spring and a back pressure chamber for urging the vane to the roller. The back pressure chamber normally communicates with the interior of the hermetic shell case, and high pressure refrigerant which is compressed by the second rotary compression element and discharged into the hermetic shell case flows into the back pressure chamber so as to urge the vane against the roller together with the spring.

However, if there is proposed an internal high pressure multistage compression type rotary compressor as set forth above, the pressure inside the hermetic shell case becomes very high so that if the pressure (high pressure) in the hermetic shell case is supplied to the back pressure chamber of the first rotary compression element, the difference between the pressure (from the lower pressure to the intermediate pressure) in the cylinder of the first rotary compression element and that (high pressure) in the back pressure chamber becomes too large, so that the pressure for pressing the vane against the roller becomes high required more than necessary. As a result, a contact pressure is heavily applied to the sliding portions of the tip end of the vane and the outer peripheral surface of the roller so that abrasion in the vane and roller proceeds and there is a likelihood that the vane and roller are damaged.

Since the difference in pressure between the pressure inside the cylinder of the first rotary compression element and that of the back pressure chamber becomes large (high pressure ranging from the low pressure to the intermediate pressure), the high pressure refrigerant in the hermetic shell case flows into the cylinder through a clearance of the vane of the first rotary compression element, thereby arising a problem of the lowering the compression efficiency.

The invention has been developed to solve such a conventional problem, and a fourth object of the invention can provide a multistage compression type rotary compressor capable of improving durability of the vane and the roller of the first rotary compression element, and of improving the compression efficiency even if the pressure in the internal of the hermetic shell case is rendered high.

When such an internal intermediate pressure multistage compression type rotary compressor is used at a district such as a cold district where an ambient temperature is low, the discharge pressure of the refrigerant which is compressed by the first rotary compression element becomes low, and hence the stage pressure of the second stage (the difference in pressure between the suction pressure of the second rotary compression element and the discharge pressure of the second rotary compression element) becomes large, arising a problem that the compression load of the second rotary compression element is increased while the durability and reliability of the compressor is lowered. Accordingly, the stage pressure of the second stage has been conventionally restrained by rendering displacement of the second rotary compression element 234 smaller by changing many components such as eccentric portions of the roller and the rotary shaft as shown at a right side in FIG. 5.

However, if the displacement ratio of the first rotary compression element relative to that of the second rotary compression element is set at an optimum value by changing many components of the rollers and the like of the second rotary compression element, there arises a problem that the cost (including the cost involved in the change of material mold, process facility and measuring equipment and the like) increases.

Further, since the balance of the rotary shaft having the eccentric portion is changed by changing each component of the second rotary compression element, it is necessary to change a balance weight attached to the electric element of the compressor for adjusting the balance of the rotary shaft.

The invention has been developed to solve such a conventional problem, and it is a fifth object of the invention to provide a multistage rotary compressor capable of easily setting an optimum displacement ratio while reducing the cost, and also provide a method of setting the displacement ratio thereof.

That is, according to the internal intermediate pressure multistage compression type rotary compressor of the first aspect of the invention, since a refrigerant introduction pipe is provided such that a part of an inlet of the refrigerant introduction pipe is positioned under the upper end of the stator of the electric element, the amount of oil which is sucked in the refrigerant introduction pipe and is discharged from the second rotary compression element to the outside compared with a case where the refrigerant introduction pipe is opened to the space under the electric element.

According to the second aspect of the invention, since adjusting means for adjusting the inner diameter of an oil discharge port of an oil path is provided in addition to the constituents of the first aspect of the invention, the amount of oil to be sucked in the second rotary compression element can be preferably adjusted while reducing the amount of oil discharged outside.

According to the rotary compressor of the third aspect of the invention, since a notch communicating with the interior of the hermetic shell case is formed on the side surface of the stator of the electric element, and the inlet of the refrigerant introduction pipe corresponds to the notch of the stator, the amount of oil which is sucked in the refrigerant introduction pipe and discharged from the second rotary compression element to the outside can be more reduced compared with a case where the refrigerant introduction pipe is opened to the space under the electric element.

According to the rotary compressor of the fourth aspect of the invention, since a notch of the stator is provided in addition to the constituents of the third aspect of the invention such that the upper end thereof is opened to the interior of the hermetic shell case over the electric element, and the lower end thereof is closed so that the refrigerant over the electric element can smoothly flow into the refrigerant introduction pipe, thereby solving the problem of the lowering of oil separation performance involved in the provision of the notch.

According to the rotary compressor of the fifth aspect of the invention, since adjusting means for adjusting the inner diameter of an oil discharge port of the oil path is provided in addition to the constituents of the third and fourth aspects of the invention, the amount of oil which is sucked in the second rotary compression element can be preferably adjusted while reducing the amount of oil discharged outside.

According to the rotary compressor of the sixth and seventh aspects of the invention, since the refrigerant in the hermetic shell case over the electric element is introduced into the second rotary compression element, and the amount of oil which is discharged through the oil discharge port of the oil path formed in the rotary shaft and is positioned at the upper end of the rotary shaft is adjusted by adjusting an inner diameter of the oil discharge port, oil in the hermetic shell case can be smoothly separated from the refrigerant and the amount of oil to be sucked in the second rotary compression element can be preferably adjusted.

Still further, according to the multistage compression type rotary compressor of the eighth aspect of the invention, since the refrigerant introduction pipe for introducing the refrigerant in the hermetic shell case into the second rotary compression element through the outside of the hermetic shell case and a filtering means provided at the inlet side of the refrigerant introduction pipe, a foreign matter which is sucked from the hermetic shell case in the refrigerant introduction pipe can be caught and removed by the filtering means. Accordingly, it is possible to provide the rotary compressor having high reliability capable of avoiding the problem of the occurrence of abrasion or locking which is caused by the suction of the foreign matter in the second rotary compression element in advance.

According to the multistage compression type rotary compressor of the ninth aspect of the invention, since the refrigerant introduction pipe for introducing the refrigerant in the hermetic shell case into the second rotary compression element through the outside of the hermetic shell case and a filtering means provided at the outlet side of the refrigerant introduction pipe, a foreign matter which is sucked from the hermetic shell case in the second rotary compression element through the refrigerant introduction pipe can be caught and removed by the filtering means. Accordingly, it is possible to provide the rotary compressor having high reliability capable of avoiding the problem of the occurrence of abrasion or locking which is caused by the suction of the foreign matter in the second rotary compression element in advance.

According to the multistage compression type rotary compressor of the tenth aspect of the invention, since the refrigerant introduction pipe for introducing the refrigerant in the hermetic shell case into the second rotary compression element through the outside of the hermetic shell case and a filtering means provided at the interior of the refrigerant introduction pipe, a foreign matter which is sucked from the hermetic shell case in the refrigerant introduction pipe can be caught and removed by the filtering means. Accordingly, it is possible to provide the rotary compressor having high reliability capable of avoiding the problem of the occurrence of abrasion or locking which is caused by the suction of the foreign matter in the second rotary compression element in advance.

According to the multistage compression type rotary compressor of the eleventh aspect of the invention, since the refrigerant compressed by the second rotary compression element having a pressure which becomes higher than the pressure of the first rotary compression element is discharged into the hermetic shell case and the high pressure refrigerant in the hermetic shell case is discharged outside, oil contained in the refrigerant discharged from the second rotary compression element can be separated from the refrigerant in the hermetic shell case. Accordingly, the oil separation performance is improved and the amount of oil which flows outside from the compressor is reduced, thereby restraining adverse affect exerted upon an external refrigerating cycle.

According to the multistage compression type rotary compressor of the twelfth aspect of the invention, since the refrigerant compressed by the second rotary compression element having a temperature which becomes higher than the temperature of the first rotary compression element is discharged into the hermetic shell case and the high-pressure refrigerant in the hermetic shell case is discharged outside, oil contained in the refrigerant discharged from the second rotary compression element can be separated from the refrigerant in the hermetic shell case. Accordingly, the oil separation performance is improved and the amount of oil which flows outside from the compressor is reduced, thereby restraining adverse affect exerted upon an external refrigerating cycle.

Particularly, since a cylinder constituting the first rotary compression element, a back pressure chamber for applying a back pressure to a vane which is brought into contact with a roller eccentrically rotated in the cylinder and partitions the interior of the cylinder into a high-pressure chamber and low pressure chamber, and a discharge side of the first rotary compression element communicate with one another, the intermediate pressure refrigerant which is compressed by the first rotary compression element is supplied to the back pressure chamber of the vane of the first rotary compression element so that the vane is urged toward the roller.

According to the rotary compressor of the thirteenth aspect of the invention, since a refrigerant introduction pipe for introducing the refrigerant which is discharged from the first rotary compression element into the second rotary compression element through the outside of the hermetic shell case, the temperature of the refrigerant which is sucked in the second rotary compression element can be lowered.

According to the rotary compressor of the fourteenth aspect of the invention, since the first and second rotary compression elements are disposed under the electric element, and the first rotary compression element is disposed under the second rotary compression element, and the refrigerant in the hermetic shell case is discharged outside from the space over the electric element, in addition to the constituents of the foregoing aspects of the invention, oil separation performance for separating oil from the high pressure refrigerant in the hermetic shell case can be further enhanced.

According to the rotary compressor of the fifteenth aspect of the invention, carbon dioxide having a large difference in pressure between high and low pressures is used as the refrigerant.

According to the multistage compression type rotary compressor of the sixteenth aspect of the invention, since an upper cylinder constituting the second rotary compression element is expanded outward from a suction port to an extent of a predetermined angle in a direction of rotation of an upper roller, the start of compression of the refrigerant in the cylinder of the second rotary compression element is delayed.

According to a method of the seventeenth aspect of the invention, since a ratio of the displacement of the first rotary compression element relative to that of the second rotary compression element is set by expanding the upper cylinder of the second rotary compression element outward from a suction port to an extent of a predetermined angle in a direction of rotation of an upper roller to adjust an angle through which the compression by the second rotary compression element starts, the start of compression of the refrigerant in the cylinder of the second rotary compression element is delayed, thereby reducing the displacement of the second rotary compression element.

PREFERRED EMBODIMENT OF THE INVENTION

Figure 1:
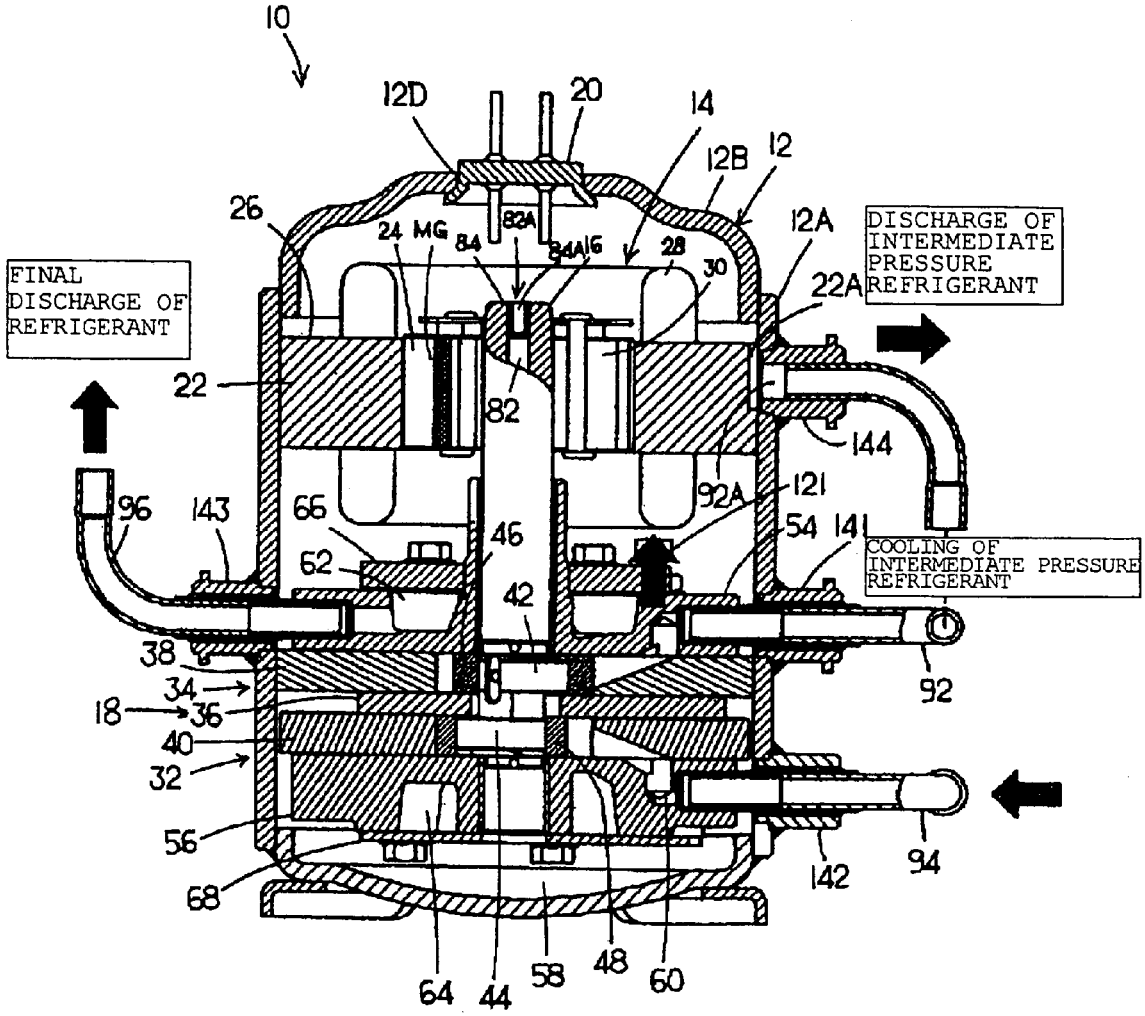
FIG. 1 is a longitudinal sectional side view of an internal intermediate pressure multistage compression type rotary compressor according to a first embodiment of the invention.
Figure 2:
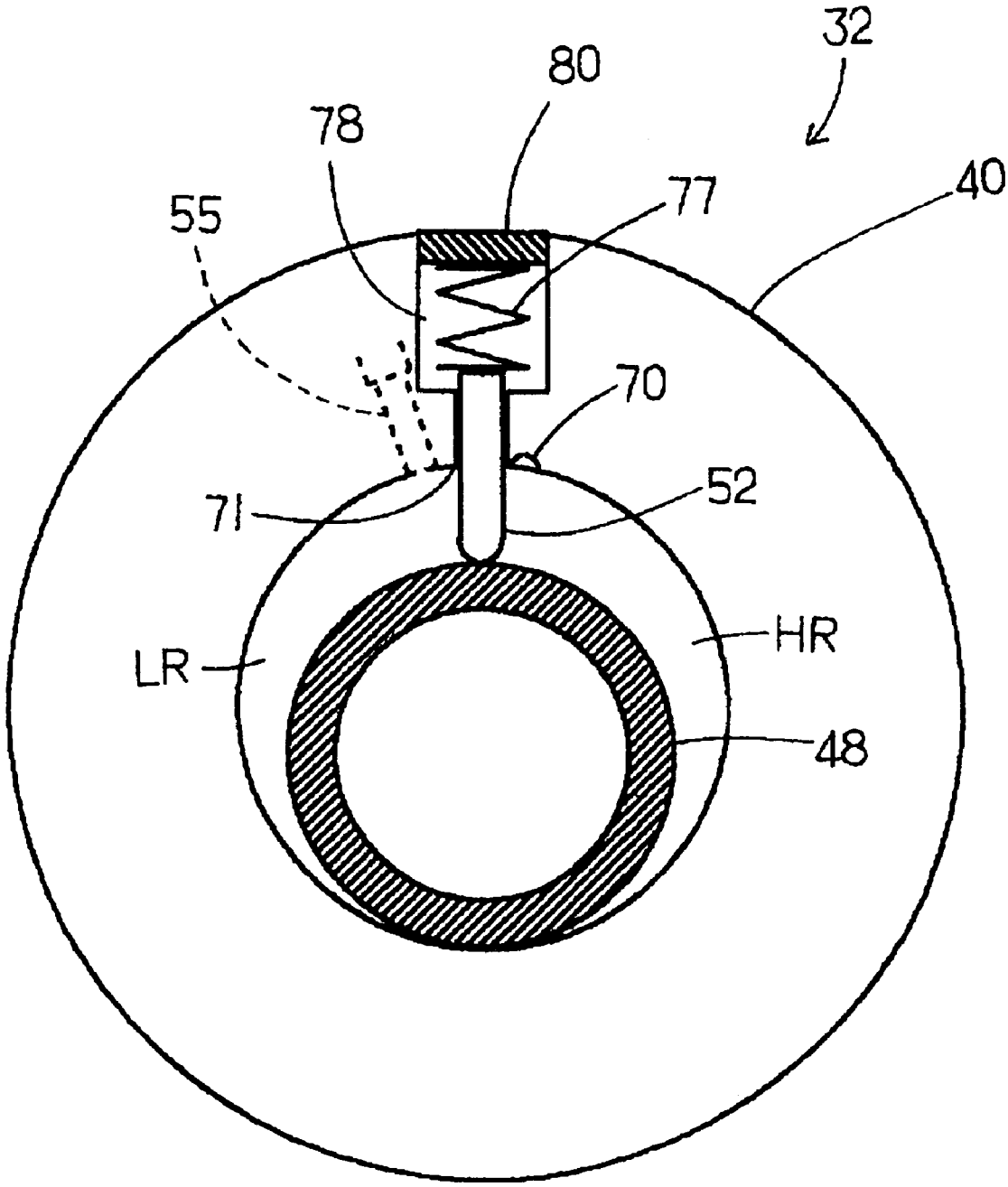
FIG. 2 is a plan view of a cylinder of a first rotary compression element of the rotary compressor in FIGS. 1, 6, 12 and 14.

An internal intermediate pressure multistage compression type rotary compressor, a method of manufacturing thereof and a method of setting displacement ratio thereof are described more in detail with reference to the attached drawings. FIG. 1 is a longitudinal sectional view showing the structure of an internal intermediate pressure type multistage rotary compressor 10 according to a first embodiment of the invention, and FIG. 2 is a plan view of a cylinder 40 of a first rotary compression element 32.

In these figures, the rotary compressor 10 is a vertical internal intermediate pressure multistage compression type rotary compressor using, e.g., carbon dioxide ($CO_2$) as refrigerant, and the rotary compressor 10 comprises a cylindrical hermetic shell case 12 made of a steel plate, an electric element 14 which is disposed and accommodated in the hermetic shell case 12 under the internal space thereof, and a rotary compression mechanism 18 comprising a first rotary compression element 32 (first stage) and a second rotary compression element 34 (second stage) which are disposed under the electric element 14 and driven by a rotary shaft 16 of the electric element 14.

The hermetic shell case 12 has a bottom serving as an oil reservoir 58 and comprises a shell case body 12A for accommodating the electric element 14 and the rotary compression mechanism 18 therein, and a substantially bowl-shaped end cap (cover body) 12B for closing the upper opening of the shell case body 12A, wherein a circular attachment hole 12D is formed on the upper surface of the end cap 12B at the center thereof, and a terminal 20 (wiring thereof is omitted) for supplying a power to the electric element 14 is attached to the attachment hole 12D.

The electric element 14 comprises a stator 22 which is annularly attached to the hermetic shell case 12 along the inner peripheral surface of the upper space of the hermetic shell case 12, and a rotor 24 which is inserted into and installed in the stator 22 with a slight clearance. The rotor 24 is fixed to the rotary shaft 16 which pierces the center of the rotor 24 and extends vertically.

The stator 22 comprises a laminated body 26 formed by laminating doughnut-shaped electromagnetic steel plates and a stator coil 28 which is wound around the teeth of the laminated body 26 by a direct winding (concentrating winding) system. The rotor 24 is also formed by a laminated body 30 made of electromagnetic steel plates like the stator 22 and a permanent magnet MG is embedded in the laminated body 30.

An intermediate partition plate 36 is sandwiched between the first rotary compression element 32 and the second rotary compression element 34. That is, both the first rotary compression element 32 and the second rotary compression element 34 of the rotary compression mechanism 18 comprise the intermediate partition plate 36, upper and lower cylinders 38, 40 which are disposed over and under the intermediate partition plate 36, upper and lower rollers 46, 48 which are engaged in upper and lower eccentric portions 42, 44 provided on the rotary shaft 16 with a 180° phase difference therebetween and eccentrically rotated in the upper and lower cylinders 38, 40, upper and lower vanes 52 (a vane at the cylinder 38 side is not shown but operates in the same manner) which are urged by a coil spring 77 (a coil spring at the cylinder 38 side is not shown but operates in the same manner) and a back pressure to be brought into contact with the upper and lower rollers 46, 48 at each tip end thereof so as to partition the interior of the upper and lower cylinders 38, 40 into a lower pressure chamber LR and a high pressure chamber HR respectively, and an upper support member 54 and a lower support member 56 as supporting members also serving as bearings of the rotary shaft 16 by closing an upper opening face of the upper cylinder 38 and a lower opening face of the lower cylinder 40.

Meanwhile, both the upper support member 54 and the lower support member 56 have a suction path 60 (suction path at the upper support member 54 side is not shown) communicating with the interior of the upper and lower cylinders 38, 40 by a suction port 55 (upper support member 54 is not shown in FIG. 2), and noise eliminating chambers 62, 64 formed by recessing a part of the upper and lower support members, 54, 56 and closing the recessed portions by an upper cover 66 and a lower cover 68.

The noise eliminating chamber 64 and the interior of the hermetic shell case 12 communicate with each other through a communication port, not shown, which pierces the upper and lower cylinders 38, 40, the intermediate partition plate 36 and the upper and lower support members 54, 56, and an intermediate discharge pipe 121 communicating with the communication path is provided upright on the upper support member 54 which becomes an upper end of the communication path. The intermediate pressure refrigerant (oil is dissolved therein) which is compressed by the first rotary compression element 32 is once discharged into the hermetic shell case 12 under the electric element 14 through the intermediate discharge pipe 121 (black arrows in FIG. 1).

At this time, although oil which lubricates and seals the interior of the first rotary compression element 32 is dissolved in the refrigerant which is discharged into the hermetic shell case 12 under intermediate pressure, this oil is separated from the refrigerant and stuck to the inner surface of the hermetic shell case 12, then transmitted along the inner surface of the hermetic shell case 12 through a space between a plain portion 22C of the stator 22, described later, and the hermetic shell case 12, and it is returned to the oil reservoir 58 at the bottom of the hermetic shell case 12.

Fixed onto the side surface of the shell case body 12A of the hermetic shell case 12 through welding are the suction paths 60 (upper path is not shown) of the upper support member 54 and the lower support member 56, sleeves 141, 143 at the position corresponding to the noise eliminating chamber 62 and the upper support member 54, a sleeve 142 at the position corresponding to the lower support member 56, and a sleeve 144 at the position corresponding to a notch 22A, described later, formed on the upper end portion (upper end portion of the shell case body 12A positioned under of the end cap 12B) of the stator 22 of the electric element 14 and the stator 22.

One end of a refrigerant introduction pipe 92 for introducing the refrigerant in the upper cylinder 38 is inserted into and connected to the sleeve 141, and it communicates with a suction path, not shown, of the upper cylinder 38. In this case, the refrigerant introduction pipe 92 is provided in the manner that an inlet 92A (the other end) thereof is positioned in the vicinity of the upper portion of the stator 22 of the electric element 14. The refrigerant introduction pipe 92 which is fixed to the sleeve 141 through welding extends to the outside of the hermetic shell case 12 and reaches the sleeve 144, and the other end thereof is inserted into and connected to the interior of the sleeve 144, while the inlet 92A is positioned at the interior of the sleeve 144 and communicates with and is opened to a space in the hermetic shell case 12 over the electric element 14 at the portion immediately above the upper portion of the stator 22 of the electric element 14. Consequently, the intermediate pressure refrigerant discharged into the hermetic shell case 12 flows from the space over the electric element 14 into the refrigerant introduction pipe 92, and passes through the outside of the hermetic shell case 12 and it is sucked into the upper cylinder 38. In this case, the sleeve 144 is fixed to the shell case body 12A of the hermetic shell case 12 through welding in the manner that a part of the lower side of the inlet 92A of the refrigerant introduction pipe 92 (about one third of the lower side of the inlet 92A in the first embodiment) is positioned under the upper end of the stator 22 of the electric element 14, while most part of the upper side of the inlet 92A (about two thirds) is positioned over the upper end of the stator 22.

In order to attach the sleeve 144 to the shell case body 12A such that the entire of the inlet 92A of the refrigerant introduction pipe 92 is opened to the upper space of the hermetic shell case 12 over the stator 22, the dimensions of the shell case body 12A which positioned over the stator 22 needs be relatively higher. However, since the refrigerant introduction pipe 92 is provided such that a part of the inlet 92A of the refrigerant introduction pipe 92 is positioned under the upper end of the stator 22 of the electric element 14, the position of the sleeve 144 (the position of the inlet 92A of the refrigerant introduction pipe 92) is lowered. As a result, a height dimension of the entire rotary compressor 10 is reduced.

The inlet 92A of the refrigerant introduction pipe 92 which is fixed to the sleeve 144 through welding communicates with and is opened to the space in the hermetic shell case 12 positioned over the electric element 14, and the refrigerant introduction pipe 92 per se extends to the outside of the hermetic shell case 12, and it is inserted into and connected to the interior of the sleeve 141. As a result, the intermediate pressure refrigerant discharged into the hermetic shell case 12 flows into the refrigerant introduction pipe 92 from the space over the electric element 14, and passes through the outside of the hermetic shell case 12 (it is cooled under intermediate pressure during this period), then it is sucked into the upper cylinder 38.

The sleeve 142 is fixed to the hermetic shell case 12 through welding at the side surface of the lower cylinder 40 corresponding to the first rotary compression element 32. An end of a refrigerant introduction pipe 94 through which the refrigerant is introduced into the lower cylinder 40 is inserted into and connected to the sleeve 142, and it communicates with the suction path 60 of the lower cylinder 40. The other end of the refrigerant introduction pipe 94 is connected to an accumulator, not shown. A refrigerant discharge pipe 96 is inserted into and connected to the sleeve 143, and one end of the refrigerant discharge pipe 96 communicates with the noise eliminating chambers 62.

The operation of the first rotary compression element 32 is now described with reference to FIG. 2. A discharge port 70 which communicates with the noise eliminating chamber 64 via a discharge valve, not shown, and the suction port 55 are formed in the lower cylinder 40, wherein guide grooves 71 which extend in the radial direction are formed in the lower cylinder 40 between the discharge port 70 and the suction port 55. The vane 52 is slidably accommodated in the guide grooves 71. The vane 52 partitions the interior of the lower cylinder 40 into a lower pressure chamber LR and a high pressure chamber HR by allowing the tip end thereof to be brought into contact with the lower roller 48, as set forth above. The suction port 55 is opened to the lower pressure chamber LR while the discharge port 70 is opened to the high pressure chamber HR.

An accommodation portion 78 which communicates with the guide grooves 71 is positioned outside the guide groove 71 (hermetic shell case 12 side) and formed in the lower cylinder 40. The coil spring 77 is accommodated in the accommodation portion 78, and a come off prevention member 80 is inserted into and fixed to the accommodation portion 78. The tip end of the vane 52 is always urged against the lower roller 48 by the urging force of the coil spring 77. Although the structure of the second rotary compression element 34 is basically the same as the foregoing first rotary compression element 32, it is needless to say that the dimensions of the each component are differentiated.

Meanwhile, an oil path 82 is provided in the rotary shaft 16 and extends vertically while piercing the center of the rotary shaft 16, and the lower end of the oil path 82 communicates with an oil pump (not shown) for pumping up the oil from the oil reservoir 58 provided at the bottom of the hermetic shell case 12, and the upper end of the oil path 82 is opened to the upper sapce in the hermetic shell case 12 over the stator 22 at an oil discharge port 82A. The oil path 82 also communicates with sliding portions of both the first and second rotary compression elements 32, 34.

Figure 3:
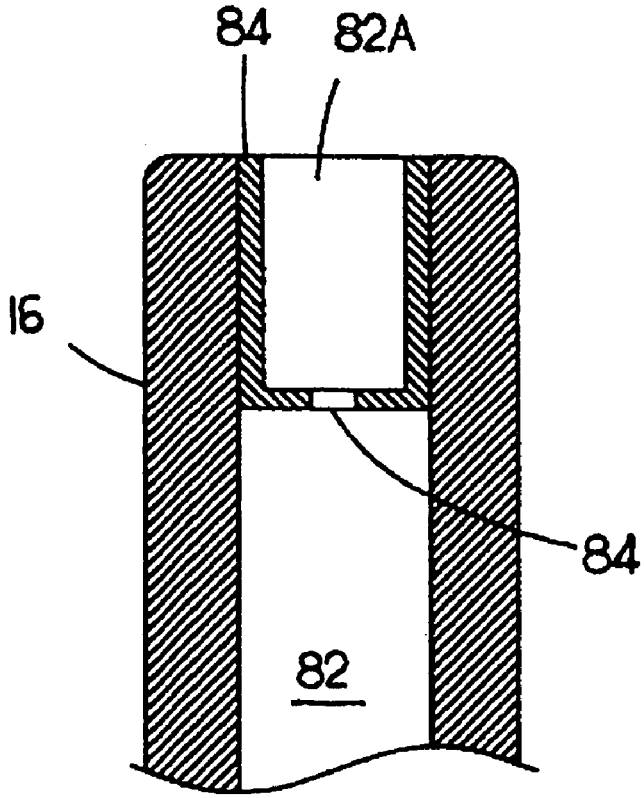
FIG. 3 is a longitudinal sectional side view of the upper portion of a rotary shaft of the rotary compressor in FIGS. 1, 6 and 12.
Figure 4:
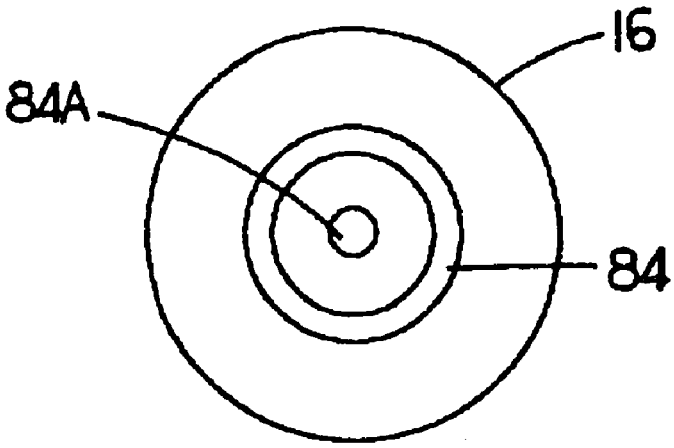
FIG. 4 is a plan view of a rotary shaft of the rotary compressor in FIG. 1.

On the other hand, an auxiliary discharge member 84 (corresponding to adjusting means of the invention) is provided in the oil discharge port 82A at the upper end of the oil path 82 (FIG. 3, FIG. 4). The auxiliary discharge member 84 is opened to the upper space and cylindrical and has a bottom and it is fixed to the oil discharge port 82A of the oil path 82 by pressing.

The auxiliary discharge member 84 has an oil discharge port 84A having a predetermined port diameter (inner diameter) at the center of the bottom surface thereof by one spot. The auxiliary discharge member 84 is positioned at the upper end of the rotary shaft 16 and closes the oil discharge port 82A of the oil path 82, thereby adjusting the amount of oil in a direction to narrow the inner diameter of the oil path 82 of the rotary shaft 16 by the oil discharge port 84A formed at the closed bottom. The inner diameter of the oil discharge port 84A is set at a size such that the oil can preferably lubricate the cooling and sliding portions of the electric element 14 in the hermetic shell case 12 and the amount of oil sucked by the second rotary compression element 34 via the refrigerant introduction pipe 92 becomes an appropriate value. As a result, the amount of oil sucked by the second rotary compression element 34 as it is and discharged outside can be reduced while securing the circulation and sealing performance in the second rotary compression element 34. Meanwhile, the size of the oil discharge port 84A of the auxiliary discharge member 84 is appropriately determined in conformity with the size of the rotary compressor 10, and the amount of oil to be discharged can be adjusted by inserting and disposing a plurality of auxiliary discharge members 84 into the rotary shaft 16 in the manner that the oil discharge ports 84A do not overlap with one another while the oil discharge ports 84A are displaced from the central position. The operation of the auxiliary discharge member 84 is described later.

Figure 6:
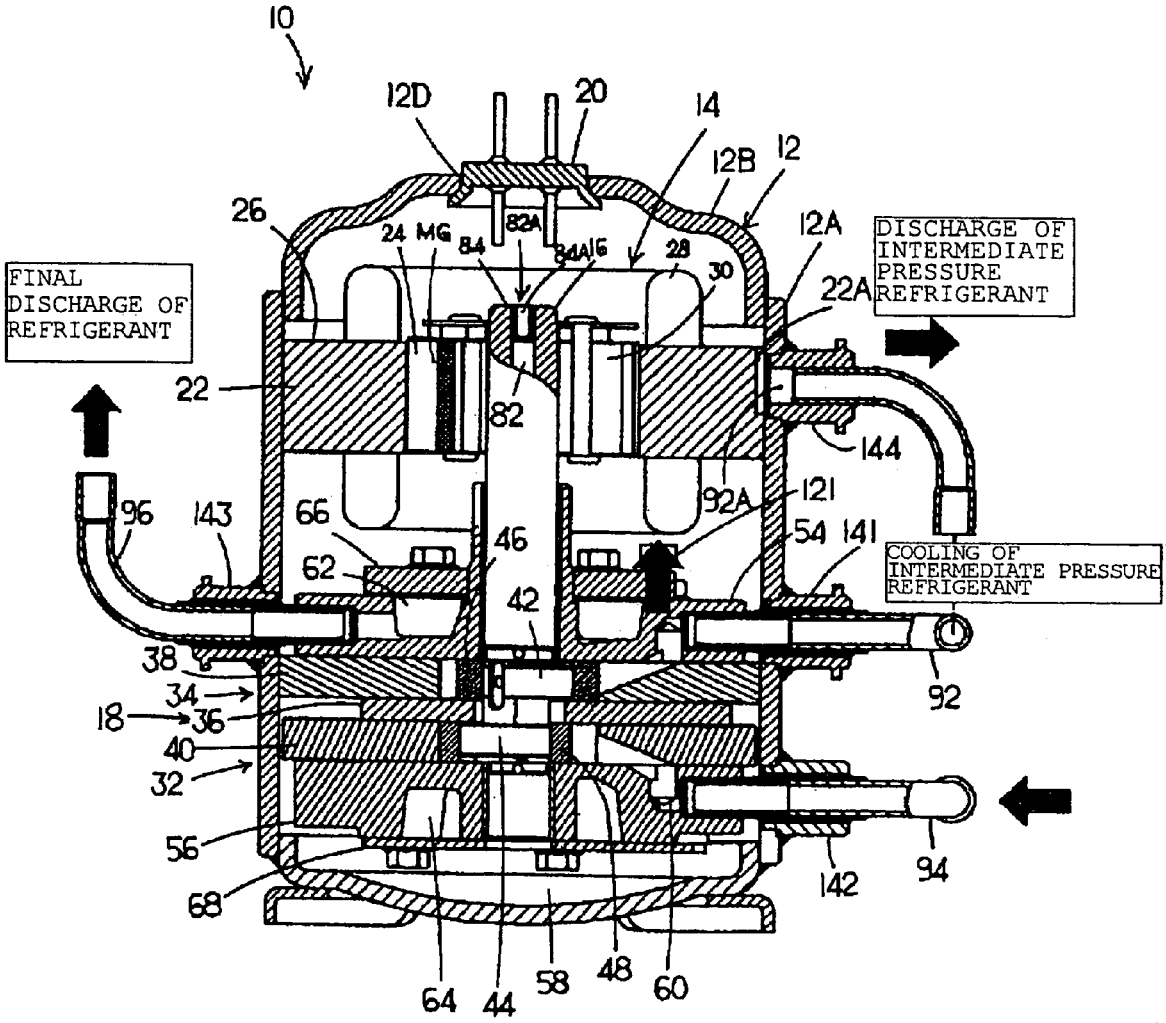
FIG. 6 is a longitudinal sectional side view of an internal intermediate pressure multistage compression type rotary compressor according to a second embodiment of the invention.

FIG. 6 is a longitudinal sectional view showing the structure of internal intermediate pressure multistage compression type rotary compressor 10 provided with first and second rotary compression elements 32, 34 according to a second embodiment of the invention. The constituents or components in FIG. 6 which are the same as those in FIG. 1 are depicted by the same reference numerals. The components in other embodiments except FIG. 6 which are the same as those in FIG. 1 are also depicted by the same reference numerals. An inlet 92A (other end) of a refrigerant introduction pipe 92 in FIG. 6 is inserted into and connected to the interior of a sleeve 144 and is opened thereto, and the sleeve 144 communicates with an interior of a notch 22A, described later, formed in a stator 22 of an electric element 14.

Figure 7:
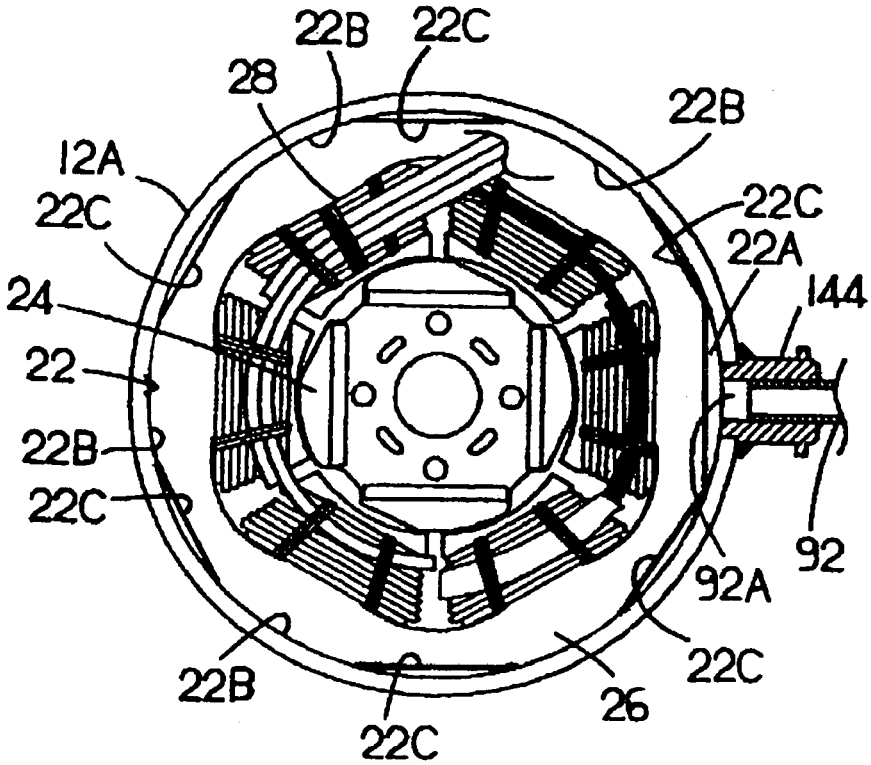
FIG. 7 is a sectional plan view of the rotary compressor in FIG. 6.
Figure 8:
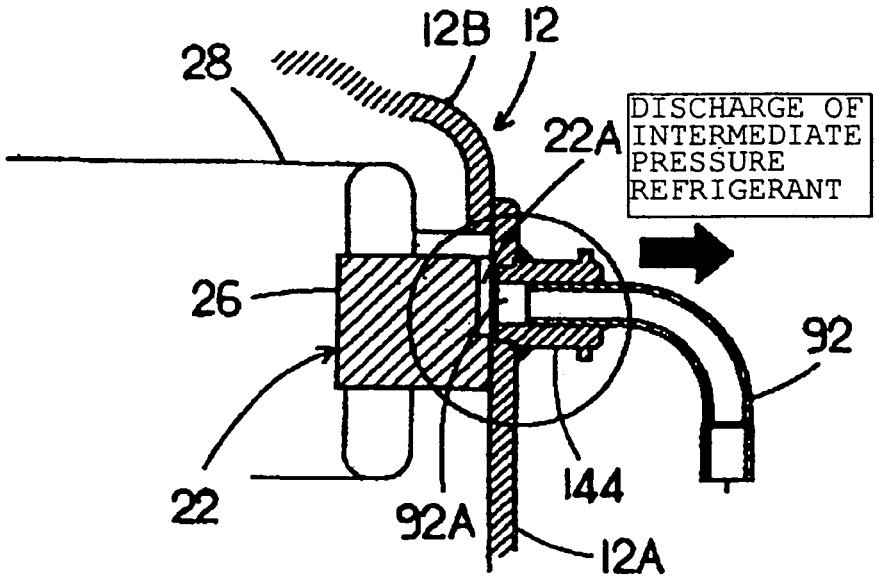
FIG. 8 is an enlarged sectional view showing a notch of a stator of the rotary compressor in FIG. 6.

The notch 22A is formed at the upper portion of the side surface of the stator 22 and the upper end thereof communicates with the interior of the hermetic shell case 12 over the electric element 14, and the lower end thereof is closed (FIG. 7, FIG. 8). The periphery of the stator 22 has engagement portions 22B which engage in the inner surface of the shell case body 12A of the hermetic shell case 12 at substantially the same distance, and plane portions 22C formed by notching which do not contact the inner surface of the shell case body 12A of the hermetic shell case 12 with a predetermined clearance (upper and lower portion thereof are opened to the interior of the hermetic shell case 12) between the shell case body 12A of the hermetic shell case 12 and the plane portions 22C (FIG. 7). These engagement portions 22B and plane portions 22C are alternately formed by twelve spots, and the notch 22A is formed in such a manner that one of the engagement portions 22B is notched in a direction from an end cap 12B at the upper portion toward an oil reservoir 58 at the lower portion by a predetermined dimension (reaching slightly lower side from the center of the stator 22 according to the second embodiment).

The notch 22A is provided in correspondence with the sleeve 144 and is notched in width by the shape substantially the same or slightly greater than the inlet 92A of the refrigerant introduction pipe 92, and it communicates with the interior of the hermetic shell case 12 over the electric element 14 and also with the inlet 92A of the refrigerant introduction pipe 92. The notch 22A is provided for sucking the refrigerant which is discharged into the hermetic shell case 12 through an intermediate discharge pipe 121 and moved upward over the electric element 14.

A clearance between the plane portions 22C and inner surface of the hermetic shell case 12 communicates with the interior of hermetic shell case 12 over and lower the stator 22 for moving the refrigerant which is discharged under the electric element 14 upward, and flowing oil which is stuck to the inner surface of the hermetic shell case 12 downward toward the oil reservoir 58 at the bottom of the hermetic shell case 12. An oil escape path through which oil is escaped toward the other plane portions 22C or under the electric element 14 may be provided at the position which is located under the inlet 92A of the notch 22A. With such a structure, the problem of introduction of oil, which flows downward toward the interior of the notch 22A and flows into the refrigerant introduction pipe 92 is solved. The operation thereof is described later.

Figure 14:
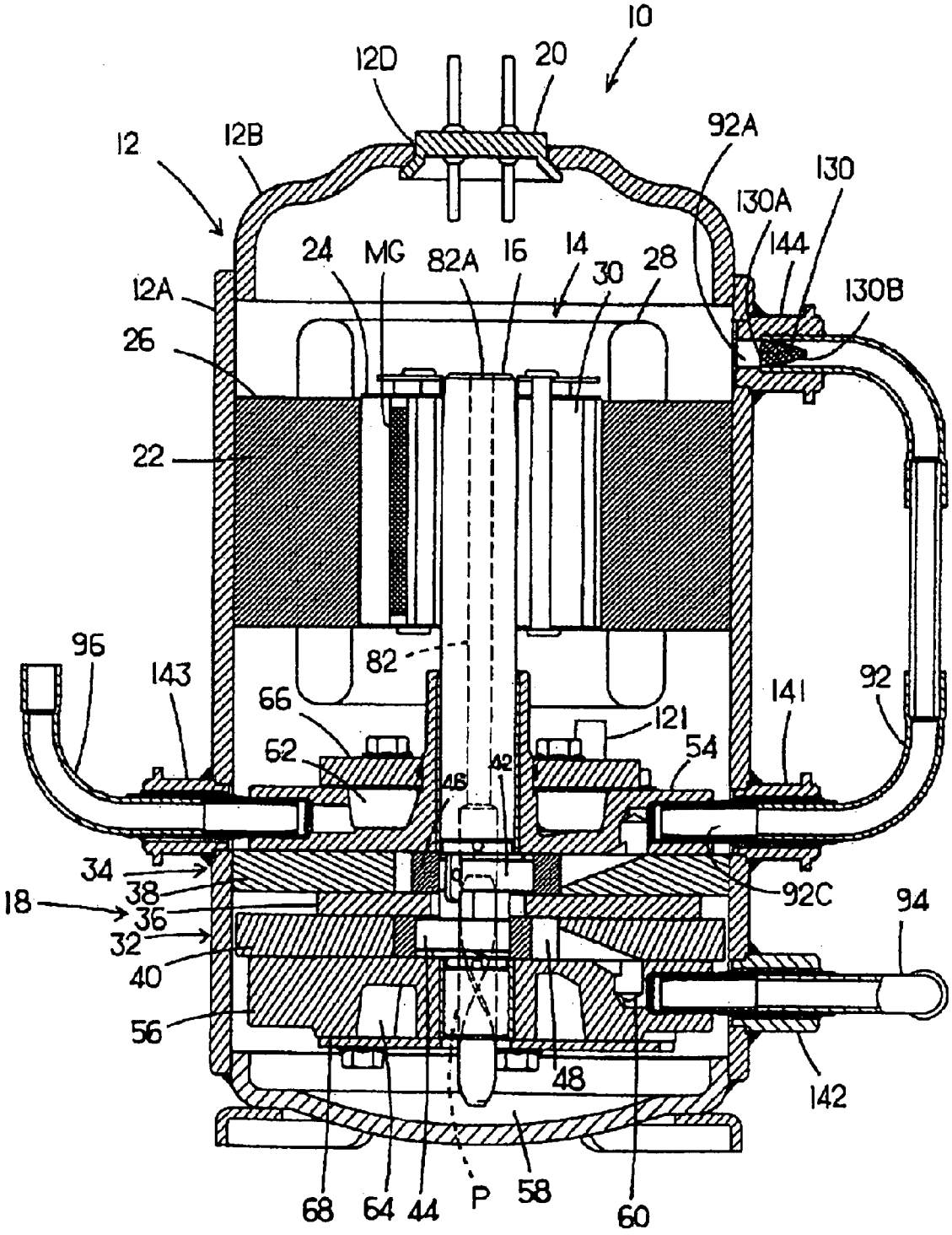
FIG. 14 is a longitudinal sectional side view of an internal intermediate pressure multistage compression type rotary compressor according to a third embodiment of the invention.

FIG. 14 is a longitudinal sectional view showing the structure of internal intermediate pressure multistage compression type rotary compressor 10 provided with first and second rotary compression elements 32, 34 according to a third embodiment of the invention. A filter 130 (filtering means of the invention) is provided in an inlet 92A of a refrigerant introduction pipe 92. The filter 130 catches and filters a foreign matter such as dust and a cut waste mixed in refrigerant which is circulated in a refrigeration circuit including a hermetic shell case 12, and it has an opening portion 130A formed at one end and a tip end portion 130B which is tapered from the opening portion 130A toward the other end thereof, representing substantially conical shape. The filter 130 partitions the interior of the inlet 92A of the refrigerant introduction pipe 92 into an inner side of the hermetic shell case 12 (upstream side) and an inner side of the refrigerant introduction pipe 92 (downstream side) so that it is mounted in the inlet 92A such that the opening portion 130A is brought into intimate contact with the inner surface of the refrigerant introduction pipe 92 so that all the foreign matters entering from the hermetic shell case 12 into the refrigerant introduction pipe 92 can be filtered. As a result, the foreign matter such as a dust and cut waste remaining in the hermetic shell case 12 can be filtered by the filter 130. Although the filter 130 is attached to the interior of the inlet 92A of the refrigerant introduction pipe 92 according to the third embodiment shown in FIG. 14, it may be attached to an interior of a sleeve 144 at the front portion of the refrigerant introduction pipe 92 (inner side of the hermetic shell case 12), and the like.

When the filter 130 catches the foreign matter, the opening portion 130A is disposed in a direction of the upstream side of the refrigerant introduction pipe 92 while the tip end portion 130B is disposed in a direction of the downstream side of the refrigerant introduction pipe 92 so that the path in the refrigerant introduction pipe 92 is not blocked off by the foreign matter. That is, the filter 130 is mounted in the refrigerant introduction pipe 92 in the manner that the opening portion 130A is positioned at the inlet 92A of the refrigerant introduction pipe 92 (upstream side of the refrigerant) and the tip end portion 130B is positioned at the downstream side of the refrigerant gas. Further, the filter 130 is formed of a wire mesh, a synthetic resin mesh, or a synthetic resin which can filter the foreign matter such as a dust and a cut waste remaining in the hermetic shell case 12, and is not easily deteriorated by refrigerant which is sealed in the hermetic shell case 12 or an oil which is dissolved into the refrigerant gas, and is not easily broken when filtering the foreign matter such as a dust and a cut waste.

There is a possibility that the foreign matter such as a dust, welding waste and the like which are produced by cutting and welding a material of components such as the hermetic shell case 12, the electric element 14 or the rotary compression mechanism 18 and the like remains in the hermetic shell case 12 constituting the rotary compressor 10. In such a case, although the foreign matter such as a dust, or a cut waste produced by cutting or welding the material of the components when manufacturing the rotary compressor 10 is removed by cleaning, there is a possibility that such a foreign matter is not cleaned but remains in the hermetic shell case 12 and also the foreign matter can be sucked from an external refrigeration circuit, and hence the filter 130 of the invention is provided for filtering such the foreign matter.

Figure 17:
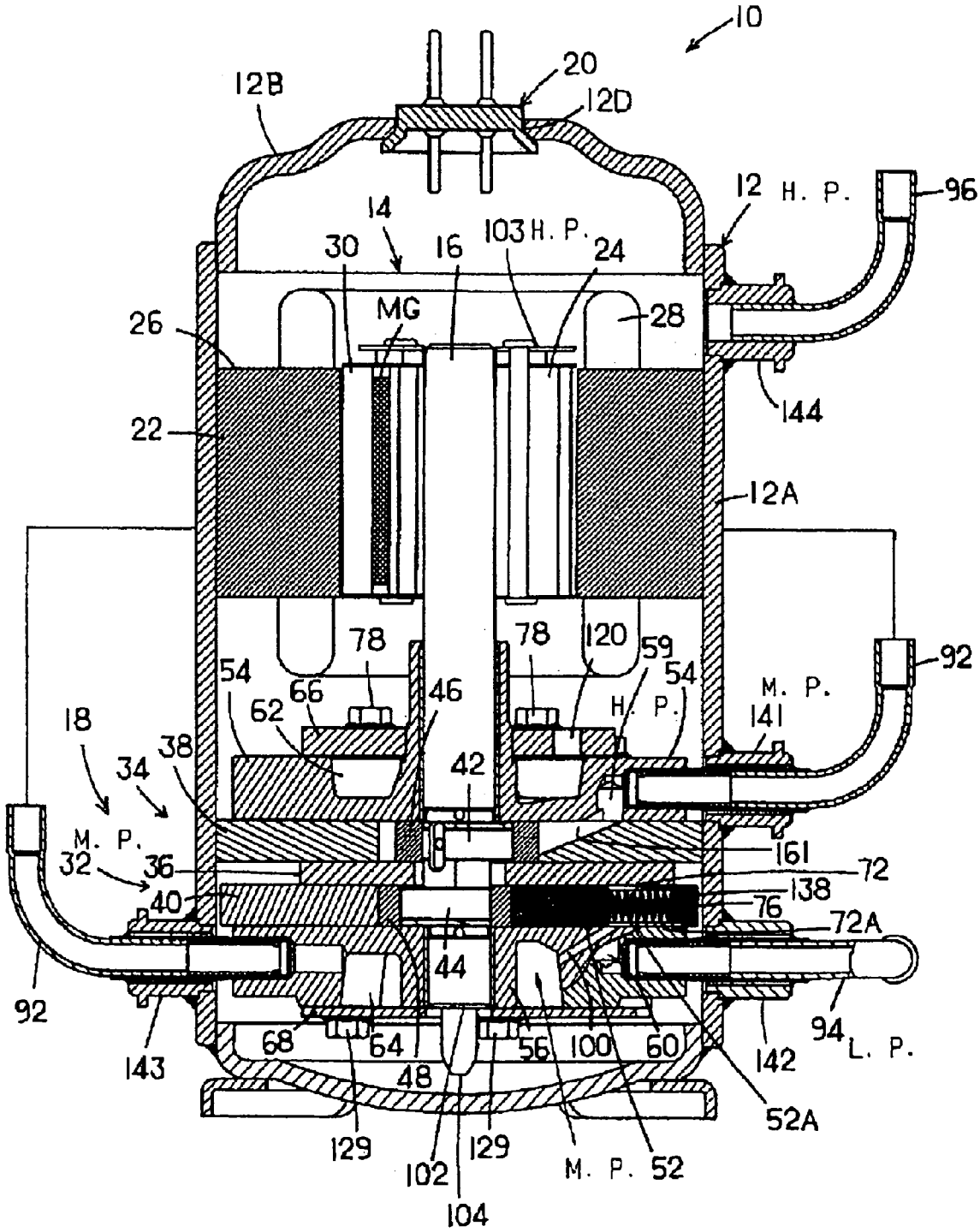
FIG. 17 is a longitudinal sectional side view of an internal intermediate pressure multistage compression type rotary compressor according to a fifth embodiment of the invention.

FIG. 17 is a longitudinal sectional view showing the structure of an internal intermediate pressure multistage compression type rotary compressor 10 provided with first and second rotary compression elements 32, 34 according to a fourth embodiment of the invention. The rotary compressor 10 of the invention is an internal high-pressure type multistage rotary compressor, described later.

In FIG. 17, the multistage compression type rotary compressor 10 comprises a cylindrical hermetic shell case 12 comprised of a cylindrical shell case body 12A made of a steel plate and a substantially bowl-shaped end cap (cover body) 12B for closing the upper opening of the shell case body 12A, an electric element 14 which is disposed and accommodated in the hermetic shell case 12 at the upper side of the internal space thereof, and a rotary compression mechanism 18 comprising first rotary compression element 32 and a second rotary compression element 34 which are disposed under the electric element 14 and driven by a rotary shaft 16 of the electric element 14.

The hermetic shell case 12 has a bottom serving as an oil reservoir 58. A circular attachment hole 12D is formed on the upper surface of the end cap 12B at the center thereof, and a terminal 20 (wiring thereof is omitted) for supplying a power to the electric element 14 is attached to the attachment hole 12D. Since the interior of the hermetic shell case 12 is rendered high pressure, it assumes that the terminal 20 becomes internal high pressure matching type, and it is not welded at the central pipe.

The electric element 14 comprises a stator 22 which is annularly attached to the hermetic shell case 12 along the inner surface of the shell case body 12A in the upper space of the hermetic shell case 12, and a rotor 24 which is inserted into and installed in the stator 22 with a slight clearance between the rotor 24 and the inner side of the stator 22. The rotor 24 is fixed to the rotary shaft 16 which extends vertically.

The stator 22 comprises a laminated body 26 formed by laminating doughnut-shaped electromagnetic steel plates and a stator coil 28 which is wound around the teeth of the laminated body 26 by a direct winding (concentrating winding) system. The rotor 24 is also formed by a laminated body 30 made of electromagnetic steel plates like the stator 22 and a permanent magnet MG is embedded in the laminated body 30. After the permanent magnet MG is inserted into the laminated body 30, upper and lower end faces of the laminated body 30 are covered with non-magnetic end face members, and a balance weight 101 (a balance weight at the lower side of the laminated body 30 is not shown) is attached to the face of the end face member which does not contact the laminated body 30, and further an oil separation plate 102 is attached to the upper side of the balance weight 101, positioned over the laminated body 30 while overlapping therewith. These rotor 24, the balance weight 101, the oil separation plate 103 are pierced by a rivet 104 and they are integrated with one another.

An oil separation plate 103 is attached to the end portion (upper end portion) of the electric element 14 side of the rotary shaft 16 and positioned over the rotor 24. Meanwhile, an oil pump 102 serving as an oil supply means is formed at the end portion (lower end portion) of the first rotary compression element 32 side of the rotary shaft 16. The oil pump 102 is provided for pumping up oil for lubrication from the oil reservoir provided on the bottom of the hermetic shell case 12 and supplying the oil to sliding portions of the rotary compression mechanism 18 and the like, and preventing abrasion and effecting sealing, a lower end 103 of the oil pump 102 is positioned in the oil reservoir.

A fifth embodiment of the invention is now described in detail. An intermediate partition plate 36 is sandwiched between a first rotary compression element 32 and a second rotary compression element 34 in FIG. 17, and the first rotary compression element 32 is positioned under the intermediate partition plate 36 while the second rotary compression element 34 is positioned over the intermediate partition plate 36 (i.e. over the first rotary compression element 32). That is, both the first and second rotary compression elements 32, 34 comprise the intermediate partition plate 36, upper and lower cylinders 38, 40 disposed over and under the intermediate partition plate 36, upper and lower rollers 46, 48 which are engaged in upper and lower eccentric portions 42, 44 provided on the rotary shaft 16 with a 180° phase difference therebetween and eccentrically rotated in the upper and lower cylinders 38, 40, vanes not shown, which is brought into contact with the upper and lower rollers 46, 48 so as to partition the interior of the upper and lower cylinders 38, 40 into a lower pressure chamber and a high pressure chamber respectively, and an upper support member 54 and a lower support member 56 as supporting members also serving as bearings of the rotary shaft 16 by closing an upper opening face of the upper cylinder 38 and the lower opening face of the lower cylinder 40.

Guide grooves 72 for accommodating the vane 52 are formed in the lower cylinder 40 constituting the first rotary compression element 32 and an accommodation portion 72A for accommodating a spring 76 serving as a spring member is formed at the outside of the guide grooves 72, namely, at the back side of the vane 52. The spring 76 contacts the end portion of the back surface end of the vane 52 to always urge the vane 52 against the lower roller 48. The accommodation portion 72A is opened to the guide grooves 72 and the hermetic shell case 12 (shell case body 12A), and a metallic plug 138 is provided at the hermetic shell case 12 side of the spring 76 which is accommodated in the accommodation portion 72A to prevent the spring 76 from coming off. Further, an O-ring, not shown, for sealing between the metallic plug 138 and the inner surface of the accommodation portion 72A is attached to the peripheral surface of the metallic plug 138.

Further, a back pressure chamber 52A for applying a refrigerant discharge pressure of the first rotary compression element 32 to the vane 52 is provided between the guide grooves 72 and the accommodation portion 72A for always urging the spring 76 and the vane 52 toward the lower roller 48. The lower surface of the back pressure chamber 52A communicates with a communication path 100, described later. Both the back pressure chamber 52A and the interior of the hermetic shell case 12 are separated from each other by the metallic plug 138.

There are provided, in the upper support member 54 and the lower support member 56, suction paths 59, 60 which communicate with interiors of the upper and lower cylinders 38, 40 through a suction port 161 (a suction port of the first rotary compression element 32 is not shown), and noise eliminating chambers 62, 64 which are formed by closing recessed portions of the upper and lower support members 54, 56 by covers serving as a wall. That is, the noise eliminating chamber 62 is closed by an upper cover 66 as a wall for forming the noise eliminating chamber 62 and the noise eliminating chamber 64 is closed by a lower cover 68.

The communication path 100 is formed in the lower support member 56. The communication path 100 is a path for allowing the noise eliminating chamber 64 which communicates with a discharge port, not shown, of the lower cylinder 40 of the first rotary compression element 32 to communicate with the back pressure chamber 52A. The communication path 100 communicates with the back pressure chamber 52A at the upper side while communicating with the noise eliminating chamber 64 at the lower side. Then, the vane 52 of the first rotary compression element 32 is urged against the lower roller 48 by an intermediate pressure of refrigerant which is compressed by the first rotary compression element 32, and discharged into the noise eliminating chamber 64 through a discharge port, not shown, then passes through the communication path 100 and flows into the back pressure chamber 52A.

As a result, the difference in pressure between the interior of the lower cylinder 40 of the first rotary compression element 32 and the back pressure chamber 52A can be reduced compared with the case where a pressure inside the hermetic shell case 12 which becomes high pressure is supplied to the vane 52 of the first rotary compression element 32 as a back pressure, and hence the load applied to the tip end of the vane 52 can be reduced while preventing a so-called jumping of a vane. Accordingly, the improvement of reliability of the rotary compressor 10 can be enhanced.

Further, since the amount of refrigerant which leaks from the guide grooves 72 of the vane 52 of the first rotary compression element 32 to the interior of the lower cylinder 40 can be reduced, the improvement of compression efficiency can be enhanced.

The lower cover 68 is formed of a doughnut-shaped circular steel plate, and it is fixed to the lower support member 56 by main bolts 129, . . . at four spots of the periphery thereof from the lower side thereof. Each tip end of the main bolts 129, . . . is screwed with the upper support member 54.

The noise eliminating chamber 64 of the first rotary compression element 32 and the suction path 59 of the second rotary compression element 34 communicate with each other by the refrigerant introduction pipe 92. The refrigerant introduction pipe 92 is positioned outside the hermetic shell case 12, and the refrigerant discharged into the noise eliminating chamber 64 passes the outside of the hermetic shell case 12 through the refrigerant introduction pipe 92, and is introduced into the second rotary compression element 34.

Further, at this time, oil which is supplied to the first rotary compression element 32 is mixed in the refrigerant which is supplied to the second rotary compression element 34, and the refrigerant including a large amount of this oil is directly sucked in the second rotary compression element 34. Accordingly, a sufficient amount of oil is supplied to the second rotary compression element 34 without trouble.

In such a manner, oil rich refrigerant containing therein oil which is supplied to the first rotary compression element 32 can be introduced into the second rotary compression element 34 as it is by causing the refrigerant which is compressed by the first rotary compression element 32 to be sucked in the second rotary compression element 34 via the refrigerant introduction pipe 92 as it is without being discharged into the hermetic shell case 12.

Accordingly, it is possible to supply oil to the second rotary compression element 34 without using a special device for supplying oil to the sliding portions of the second rotary compression element 34, and hence it is possible to solve the problem of short of oil to be supplied to the second rotary compression element 34.

Further, an oil supply mechanism to supply oil to the second rotary compression element 34 can be simplified, and hence the manufacturing cost of the oil supply mechanism can be reduced.

Still further, since the refrigerant which is compressed by the first rotary compression element 32 is introduced into the second rotary compression element 34 via the refrigerant introduction pipe 92 which is provided outside the hermetic shell case 12, the refrigerant which is compressed by the first rotary compression element 32 can be cooled during the passage through the outside of the hermetic shell case 12. As a result, it is possible to lower the temperature of the refrigerant which is sucked in the second rotary compression element 34, thereby enhancing the improvement of compression efficiency.

The electric element 14 is provided over the upper cover 66 with a predetermined distance between the upper cover 66 and the electric element 14. The upper cover 66 is fixed to the upper support member 54 from the above by four main bolts 78, . . . at the periphery thereof. Each tip end of the main bolts 78, . . . is screwed with the lower support member 56.

The noise eliminating chamber 62 of the second rotary compression element 34 and the interior of the hermetic shell case 12 communicate with each other by a discharge port 120 which pierces the upper cover 66 and is opened to the electric element 14 inside the hermetic shell case 12, and a high pressure refrigerant which is compressed by the second rotary compression element 34 is discharged into the hermetic shell case 12 through the discharge port 120. At this time, although oil to be supplied to the first and second rotary compression elements 32, 34 is mixed in the refrigerant, this oil is also discharged into the hermetic shell case 12. Then, the oil is separated from the refrigerant during the passage through the space inside the hermetic shell case 12, and flows downward into the oil reservoir provided at the bottom of the hermetic shell case 12 and reserved therein.

Carbon dioxide ($CO_2$) which is natural refrigerant is used as refrigerant in this case considering earth consciousness, inflammability, toxicity or the like, and an existing oil such as mineral oil, alkylbenzene oil, ether oil, ester oil, PAG (polyalkylglycol) or the like is used as the oil of the lubricant.

Sleeves 141, 142, 143 and 144 are respectively fixed to the side surface of the shell case body 12A of the hermetic shell case 12 through welding at the positions corresponding to the suction paths 59, 60 of the upper support member 54 and the lower support member 56, the noise eliminating chamber 64, and the upper portion of the rotor 24 (immediately over the electric element 14). The sleeves 141 and 142 adjoin vertically each other and the sleeve 143 is located substantially at a diagonal line of the sleeve 142. Further, the sleeve 144 is positioned over the sleeve 141. One end of the refrigerant introduction pipe 92 through which the refrigerant is introduced into the upper cylinder 38 is inserted into and connected to the sleeve 141.

The refrigerant introduction pipe 92 is provided for supplying the refrigerant which is compressed by the first rotary compression element 32 to the second rotary compression element 34, as set forth above, and one end of the refrigerant introduction pipe 92 communicates with the suction path 59 of the upper cylinder 38. The refrigerant introduction pipe 92 extends to the outside of the hermetic shell case 12 and reaches the sleeve 143 and the other end thereof is inserted into and connected to the sleeve 143 to communicate with the noise eliminating chamber 64 of the first rotary compression element 32.

One end of a refrigerant introduction pipe 94 for introducing refrigerant into the lower cylinder 40 is inserted into and connected to the sleeve 142, and it communicates with the suction path 60 of the lower cylinder 40. The other end of the refrigerant introduction pipe 94 is connected to an accumulator, not shown, constituting the refrigeration circuit.

Further, the refrigerant discharge pipe 96 is inserted into and connected to the interior of the sleeve 144 and one end of the refrigerant discharge pipe 96 communicates with the interior of the hermetic shell case 12 over the electric element 14. In such a manner, since the refrigerant discharge pipe 96 is provided at the space over the electric element 14, oil which is discharged into the hermetic shell case 12 under the electric element 14 together with the refrigerant compressed by the second rotary compression element 34 passes through the electric element 14 and reaches the space over the electric element 14 and it is discharged outside through the refrigerant discharge pipe 96. In such a manner, since the refrigerant discharged from the second rotary compression element 34 moves in the space inside the hermetic shell case 12, the oil dissolved in the refrigerant is smoothly separated from the refrigerant. Further, since the refrigerant passes through an oil separation plate 103 provided over the electric element 14

(upper end of the rotary shaft 16), the separation of oil is further accelerated. As a result, the amount of oil discharged outside the rotary compressor 10 (in the refrigeration circuit of the refrigerating cycle) together with the refrigerant can be effectively reduced.

Further, since the oil rich refrigerant is sucked in the second rotary compression element 34 as set forth above, the increase of the temperature of the second rotary compression element 34 can be restrained. Accordingly, the increase of temperature of the electric element 14 is also restrained, resulting in the improvement of the performance and reliability of the rotary compressor 10.

Figure 18:
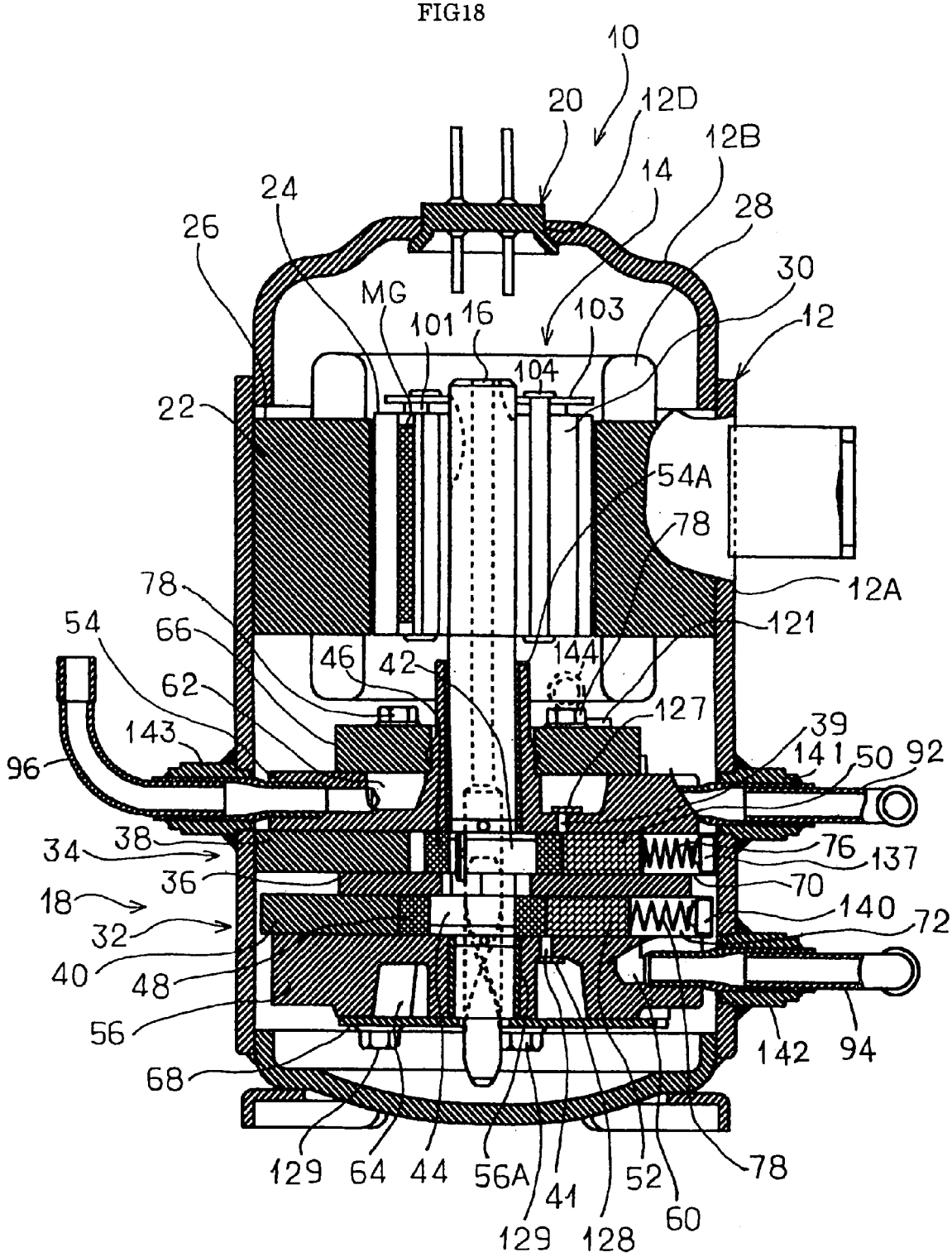
FIG. 18 is a longitudinal sectional side view of an internal intermediate pressure multistage compression type rotary compressor according to a sixth embodiment of the invention.
Figure 19:
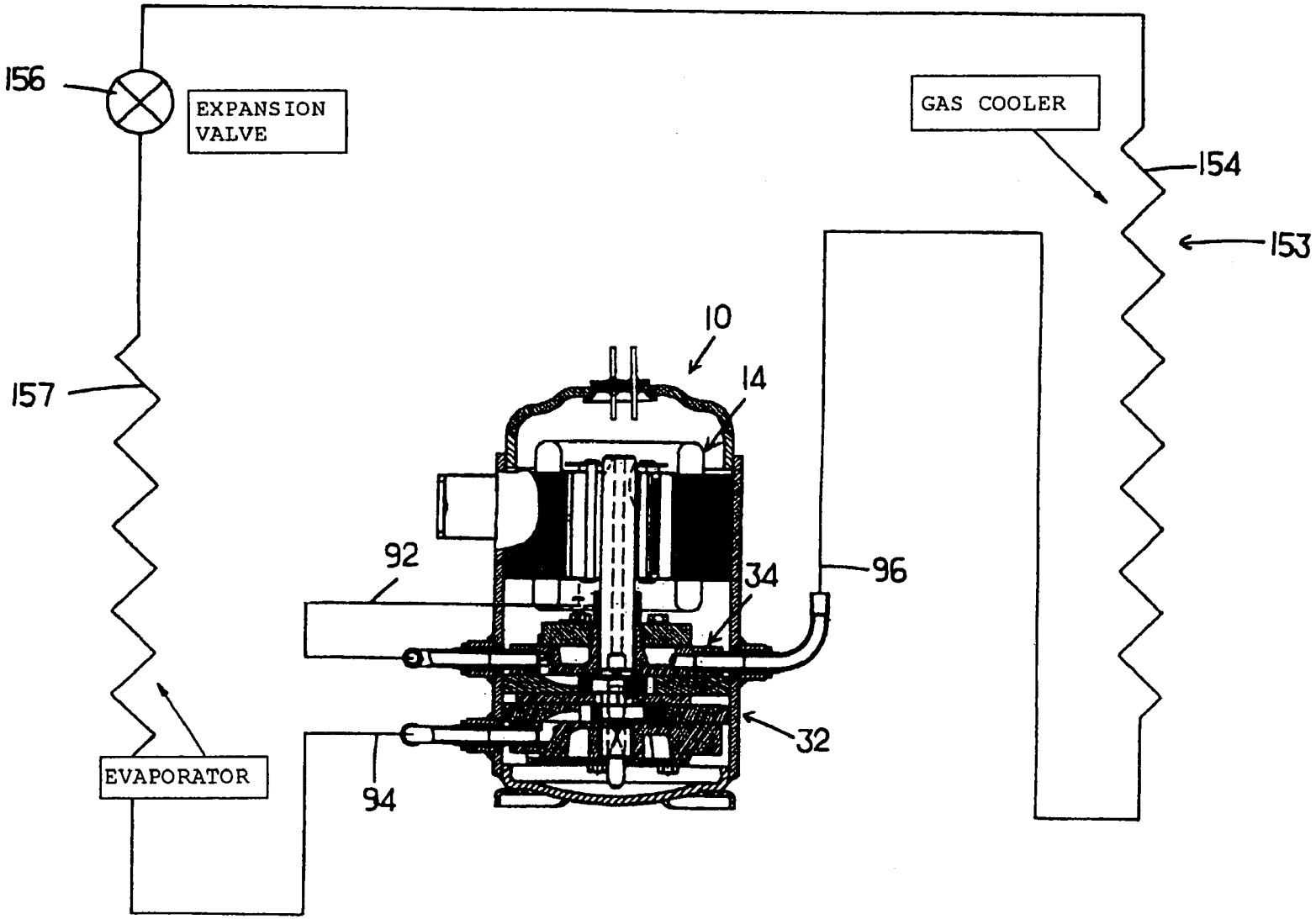
FIG. 19 is a longitudinal sectional side view showing a refrigerating cycle of an oil supply unit of the rotary compressor in FIG. 18.
Figure 20:
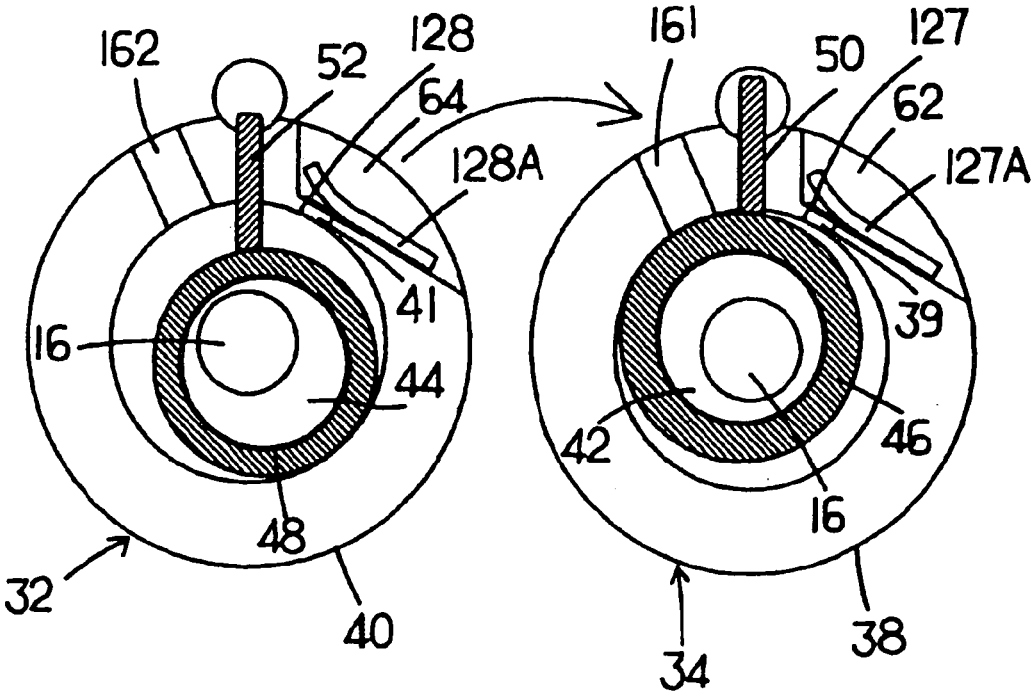
FIG. 20 is a longitudinal sectional view showing cylinders of first and second rotary compression elements of the rotary compressor in FIG. 18 to be used at a normal temperature.
Figure 21:
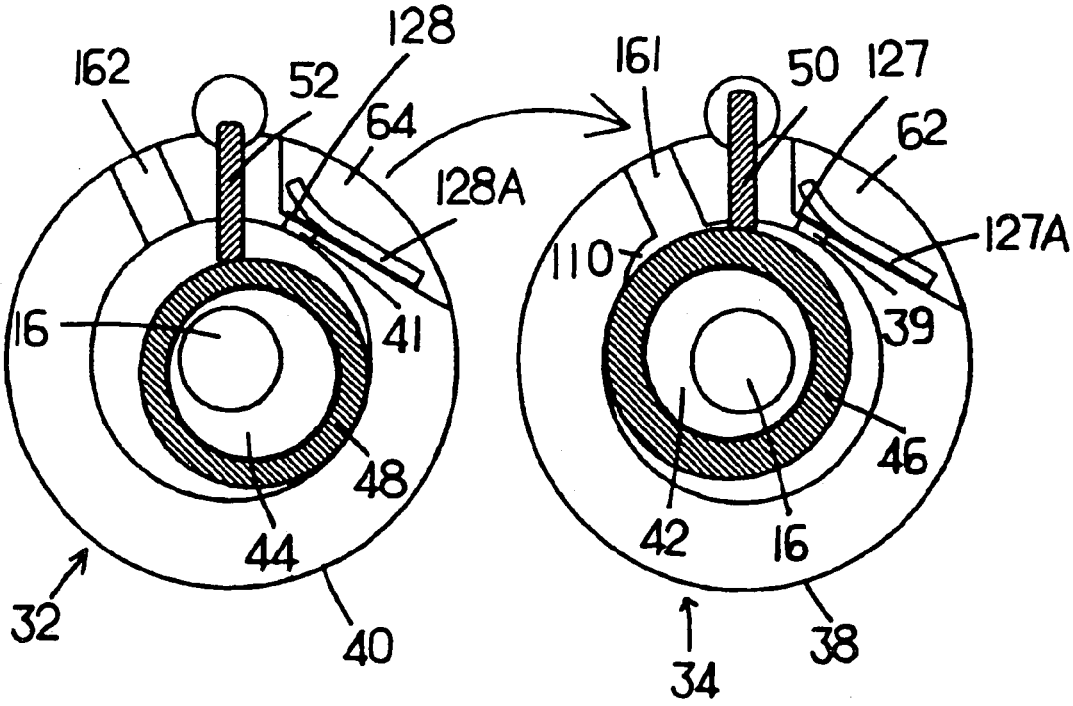
FIG. 21 is longitudinal sectional view of showing cylinders of first and second rotary compression elements of the rotary compressor in FIG. 18 to be used in a cold district.
Figure 22:
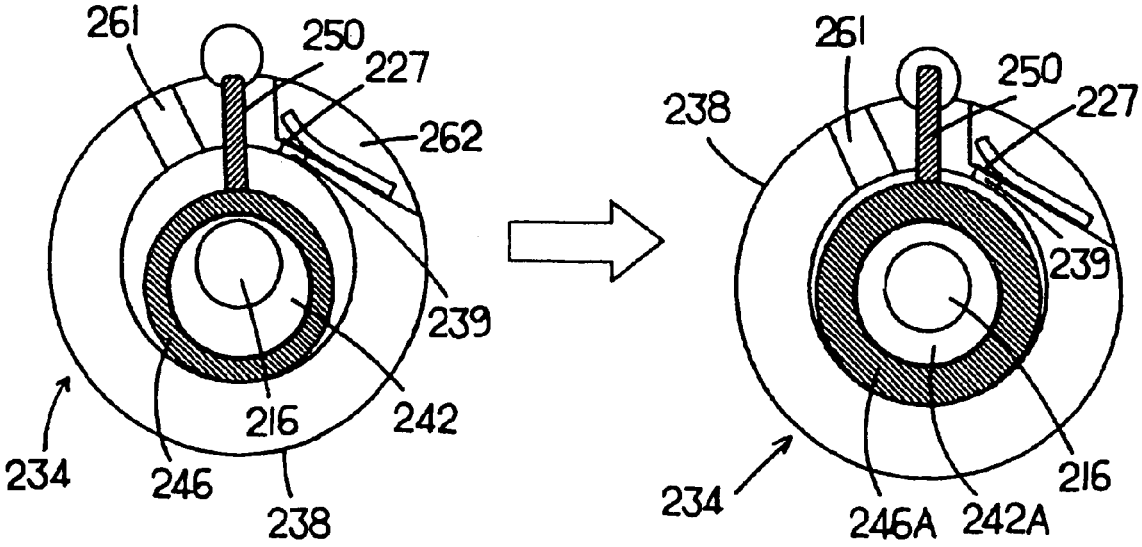
FIG. 22 is a longitudinal sectional view showing a cylinder of a second rotary compression element of a conventional rotary compressor to be used at normal temperature and in a cold district.

FIG. 18 is a longitudinal sectional view showing the internal intermediate pressure multistage (two stages) compression type rotary compressor 10 provided with first and second rotary compression elements 32, 34 according to a sixth embodiment of the invention, FIG. 19 is a circuit diagram of a refrigeration circuit in the case where the invention is applied to a hot water supply unit 153, FIG. 20 is sectional views of upper and lower cylinders 38, 40 of the first and second rotary compression elements 32, 34 of the rotary compressor 10 used at a room temperature, and FIG. 21 is a sectional views of upper and lower cylinders 38, 40 of the first and second rotary compression elements 32, 34 of the rotary compressor 10 used at a cold district to which the invention is applied.

In FIG. 18, the stator 22 comprises a laminated body 26 formed by laminating doughnut-shaped electromagnetic steel plates and a stator coil 28 which is wound around the teeth of the laminated body 26 by a direct winding (concentrating winding) system. The rotor 24 is also formed by a laminated body 30 made of electromagnetic steel plates like the stator 22 and a permanent magnet MG is inserted into the laminated body 30. After the permanent magnet MG is inserted into the laminated body 30, upper and lower end faces of the laminated body 30 are covered with non-magnetic end face members, not shown, and a balance weight 101 (a balance weight under the laminated body 30 is not shown) is attached to the face which do not contact the laminated body 30 of the end face member, and further an oil separation plate 102 is attached to the upper side of the balance weight 101 positioned over the laminated body 30 while overlapping therewith.

These rotor 24, the balance weight 101, the oil separation plate 102 are pierced by a rivet 104 and they are integrated with one another.

An intermediate partition plate 36 is sandwiched between the first rotary compression element 32 and the second rotary compression element 34. That is, both the first and second rotary compression elements 32, 34 comprise the intermediate partition plate 36, upper and lower cylinders 38, 40 disposed over and under the intermediate partition plate 36, upper and lower rollers 46, 48 which are engaged in upper and lower eccentric portions 42, 44 provided on the rotary shaft 16 with a 180° phase difference therebetween and eccentrically rotated in the upper and lower cylinders 38, 40, upper and lower vanes 50, 52 which are brought into contact with the upper and lower rollers 46, 48 so as to partition the interior of the upper and lower cylinders 38, 40 into a lower pressure chamber and a high pressure chamber respectively, and an upper support member 54 and a lower support member 56 as supporting members also serving as bearings of the rotary shaft 16 by closing an upper opening face of the upper cylinder 38 and the lower opening face of the lower cylinder 40.

Although displacement of the second rotary compression element 34 is smaller than that of the first rotary compression element 32, the displacement of the second rotary compression element 34 is assumed to be large, and it is designed to have 65% of the displacement of the first rotary compression element 32 in FIG. 20.

There are provided, in the upper and lower support members 54, 56 a suction path 60 (upper suction path is not shown) which communicates with interiors of the upper and lower cylinders 38, 40 through suction ports 161, 162, and noise eliminating chambers 62, 64 which are formed by closing recessed portions of the upper and lower support members 54, 56 by covers serving as a wall. That is, the noise eliminating chamber 62 is closed by an upper cover 66 as a wall for forming the noise eliminating chamber 62 and the noise eliminating chamber 64 is closed by a lower cover 68.

In this case, a bearing 54A is formed upright on the center of the upper support member 54. A bearing 56A are formed by piercing the center of the lower support member 56, and the rotary shaft 16 is retained by the bearing 54A of the upper support member 54 and the bearing 56A of the lower support member 56.

The lower cover 68 is formed of a doughnut-shaped circular steel plate, and it is fixed to the lower support member 56 by main bolts 129, . . . at four spots of the periphery thereof from the lower side thereof, thereby forming the discharge noise eliminating chamber 64 which communicates with the interior of the lower cylinder 40 of the first rotary compression element 32 by the discharge port 41. Each tip end of the main bolts 129, . . . is screwed with the upper support member 54.

A discharge valve 128 (this is shown in the same plane in FIGS. 20 and 21 as the cylinder for the brevity of explanation) for closably closing the discharge port 41 is provided on the upper surface of the noise eliminating chamber 64. The discharge valve 128 is formed of an elastic member made of a longitudinal substantially rectangular metal plate, and one side of the discharge valve 128 is brought into contact with the discharge port 41 to seal it while the other side thereof is fixed to an attachment port, not shown, of the lower support member 56 by a caulking pin with a predetermined interval relative to the discharge port 41.

Further, a bucker valve 128A serving as a discharge valve restraining plate is disposed under the discharge valve 128, and it is attached to the lower support member 56 like the discharge valve 128.

The refrigerant which is compressed in the lower cylinder 40 and reaches a predetermined pressure pushes up the discharge valve 128 which closes the discharge port 41 to open the discharge port 41 so that it is discharged toward the noise eliminating chamber 64. At this time, since the discharge valve 128 is fixed to the lower support member 56 at the other side, one side thereof which is brought into contact with the discharge port 41 is warped up and is brought into contact with a bucker valve 128A, which restricts the amount of the opening of the discharge valve 128. When the discharge of the refrigerant approaches an end time, the discharge valve 128 is moved away from the bucker valve 128A to close the discharge port 41.

The noise eliminating chamber 64 of the first rotary compression element 32 and the interior of the hermetic shell case 12 communicate with each other through a communication port, and the communication is a port, not shown, which pieces the upper cover 66, the upper and lower cylinders 38, 40, and the intermediate partition plate 36. In this case, an intermediate discharge pipe 121 is provided upright on the upper end of the communication path. The intermediate pressure refrigerant is discharged into the hermetic shell case 12 through the intermediate discharge pipe 121.

Further, the upper cover 66 forms a discharge noise eliminating chamber 62 which communicates with the interior of the upper cylinder 38 of the second rotary compression element 34 through the discharge port 39 and the electric element 14 is provided over the upper cover 66 with a predetermined distance relative to the upper cover 66. The upper cover 66 is formed of a doughnut-shaped circular steel plate having a hole which the bearing 54A of the upper support member 54 pierces, and it is fixed to the upper support member 54 by main bolts 178, . . . at four spots of the periphery thereof from the above. Each tip end of the main bolts 178, . . . is screwed with the lower support member 56.

A discharge valve 127 (shown in the same plane in FIGS. 20 and 21 as the cylinder for the brevity of explanation) for closably closing the discharge port 39 is provided on the lower surface of the noise eliminating chamber 62. The discharge valve 127 is formed of an elastic member made of a longitudinal substantially rectangular metal plate, and one side of the discharge valve 127 is brought into contact with the discharge port 39 to seal it while the other side thereof is fixed to an attachment hole, not shown, of the upper support member 54 by a caulking pin with a predetermined interval relative to the discharge port 39.

Further, a bucker valve 127A serving as a discharge valve restraining plate is disposed over the discharge valve 127, and it is attached to the upper support member 54 like the discharge valve 127.

The refrigerant which is compressed in the upper cylinder 38 and reaches a predetermined pressure pushes up the discharge valve 127 (shown in the same plane in FIGS. 20 and 21 as the cylinder for brevity of explanation) which closes the discharge port 39 to open the discharge port 39 so that it is discharged toward the noise eliminating chamber 62. At this time, since the discharge valve 127 is fixed to the upper support member 54 at the other side, one side thereof which is brought into contact with the discharge port 39 is warped up and is brought into contact with a bucker valve 127A which restricts the amount of the opening of the discharge valve 127. When the discharge of the refrigerant approaches an end time, the discharge valve 127 is moved away from the bucker valve 127A to close the discharge port 39.

There are provided in the upper and lower cylinders 38, 40, guide grooves, not shown, for accommodating the upper and lower vanes 50, 52, and accommodation portions 70, 72 which are positioned outside the guide grooves and accommodate springs 76, 78 serving as spring members. The accommodation portions 70, 72 are opened to the guide grooves and the hermetic shell case 12 (shell case body 12A). The springs 76, 78 are brought into contact with outer end portions of the upper and lower vanes 50, 52 to always urge the upper and lower vanes 50, 52 against the upper and lower rollers 46, 48. Metal plugs 137, 140 are provided in the accommodation portions 70, 72 of the springs 76, 78 at the side of the hermetic shell case 12, and serve to prevent the springs 76, 78 from coming off.

Sleeves 141, 142, 143 and 144 are respectively fixed to the side surface of the shell case body 12A of the hermetic shell case 12 through welding at the positions corresponding to the suction path 60 (upper side is not shown) of the upper and lower support members 54, 56, the noise eliminating chamber 62, and the upper portion of the upper cover 66 (position substantially corresponding to the lower end of the electric element 14). The sleeves 141 and 142 adjoin vertically each other and the sleeve 143 is located substantially at a diagonal line of the sleeve 141. Further, the sleeve 144 is positioned while displaced substantially 90° relative to the sleeve 141.

One end of a refrigerant introduction pipe 92 for introducing the refrigerant into the upper cylinder 38 is inserted into and connected to the sleeve 141, and it communicates with a suction path, not shown, of the upper cylinder 38. The refrigerant introduction pipe 92, passes over the hermetic shell case 12 and reaches the sleeve 144, and the other end thereof is inserted into and connected to the sleeve 144 to communicate with the hermetic shell case 12.

One end of a refrigerant introduction pipe 94 for introducing refrigerant into the lower cylinder 40 is inserted into and connected to the sleeve 142, and it communicates with the suction path 60 of the lower cylinder 40. The other end of the refrigerant introduction pipe 94 is connected to a lower end of an accumulator, not shown. A refrigerant discharge pipe 96 is inserted into and connected to the sleeve 143, and one end of the refrigerant discharge pipe 96 communicates with the noise eliminating chamber 62.

Meanwhile, in the case where multistage compression type rotary compressor shown in FIG. 20 is used at a district where an ambient temperature is low such as a cold district or the like, a ratio of displacement ratio of the first rotary compression element 32 relative to that of the second rotary compression element 34 has to be changed. That is, the displacement ratio has to be changed such that the displacement of the second rotary compression element 34 is further made small.

In this case, for example, in order to set the displacement of the second rotary compression element 34 is set to be 55% of that of the first rotary compression element 32, an expansion portion 110 is formed in the upper cylinder 38 as shown in FIG. 21. The expansion portion 110 is formed by expanding the upper cylinder 38 outward from a suction port 161 to an extent of a predetermined angle in the direction of rotation of an upper roller 46. Owing to the provision of the expansion portion 110, it is possible to delay the angle through which compression of refrigerant is started by the upper cylinder 38 to the end in the direction of the rotation of upper roller 46 of the expansion portion 110. That is, the start of compression of refrigerant by the upper cylinder 38 can be delayed by the angle within which the expansion portion 110 of the upper cylinder 38 is formed.

Accordingly, the amount of refrigerant compressed in the upper cylinder 38 can be reduced, resulting in the reduction of displacement of the second rotary compression element 34.

In the seventh embodiment shown in FIG. 21, the angle within which the expansion portion 110 is formed is adjusted such that the displacement of the second rotary compression element 34 becomes 55% of that of the first rotary compression element 32. Accordingly, displacement of the second rotary compression element 34 can be reduced without changing the cylinder, the roller, the eccentric portion and the like of the second rotary compression element 34, and the increase of the pressure in the second stage (the difference between the suction pressure of the second rotary compression element 34 and the discharge pressure of the second rotary compression element 34) can be prevented.

That is, since the displacement of the second rotary compression element 34 can be reduced by merely forming the expansion portion 110 in the upper cylinder 38, it is possible to restrain the increase of cost caused by the change of components.

Furthermore, since the balance weight 101 which is attached to the end surface of the rotor 24 of the electric element 14 for adjusting the balance of the rotary shaft 16 is not needed to be changed, the cost can be further reduced.

The multistage compression type rotary compressor 10 shown in FIG. 19 constitutes the refrigeration circuit system of a hot water supply unit 153 shown in FIG. 19.

That is, the refrigerant discharge pipe 96 of the multistage compression type rotary compressor 10 is connected to a gas cooler 154. The gas cooler 154 is provided in a hot water tank, not shown, of the hot water supply unit 153 in order to heat water to produce hot water. A piping extended from the gas cooler 154 reaches an inlet of an evaporator 157 via an expansion valve 156 serving as a pressure reducing device and connected to the evaporator 157. The evaporator 157 is connected to the refrigerant introduction pipe 94 via the accumulator, not shown.

Operations in respective embodiments are now described. When the stator coil 28 of the electric element 14 is energized via the terminal 20 and wiring, not shown, in the multistage compression type rotary compressor in FIG. 1, the electric element 14 is actuated to rotate the rotor 24. When the rotor 24 is rotated, the upper and lower rollers 46, 48 which are engaged in the upper and lower eccentric portions 42, 44 integrally provided with the rotary shaft 16 are eccentrically rotated in the upper and lower cylinders 38, 40.

As a result, low pressure (about 4 MpaG) refrigerant which is sucked in the low pressure chamber LR of the lower cylinder 40 through the suction ports 55, 162 via the suction path 60 formed in the refrigerant introduction pipe 94 and the lower support member 56 is subjected to compression of first stage by the operation of the lower roller 48 and the lower vane 52 and changed into an intermediate pressure (about 8 MpaG). The intermediate pressure refrigerant is discharged into the hermetic shell case 12 under the electric element 14 through the intermediate discharge pipe 121 via the high pressure chamber HR, the noise eliminating chamber 64 and the communication path. Consequently, the interior of the hermetic shell case 12 becomes intermediate pressure. As a result, the discharge valve 128 provided in the noise eliminating chamber 64 is opened and the noise eliminating chamber 64 and the discharge port 41 communicate with each other, and hence the refrigerant passes from the high pressure chamber HR of the lower cylinder 40 through the interior of the discharge port 41 and is discharged into the noise eliminating chamber 64 formed in the lower support member 56. The refrigerant discharged into the noise eliminating chamber 64 is discharged into the hermetic shell case 12 through the intermediate discharge pipe 121 via a communication port, not shown.

The intermediate pressure refrigerant discharged into the noise eliminating chamber 64 flows into the back pressure chamber 52A of the first rotary compression element 32 through the communication path 100, thereby urging the vane 52 as well as the spring 76 in a direction of the lower roller 48. On the other hand, the other intermediate pressure refrigerant which is discharged into the noise eliminating chamber 64 enters the refrigerant introduction pipe 92 and passes through the outside of the hermetic shell case 12 and the suction path 59 of the second rotary compression element 34, then it is sucked in the low pressure chamber LR of the upper cylinder 38 through the suction port 161. At this time, the refrigerant is cooled when it passes through the refrigerant introduction pipe 92 provided at the outside of the hermetic shell case 12.

The refrigerant discharged through the intermediate discharge pipe 121 passes through the electric element 14 and a clearance between the electric element 14 (depicted by 22C in plan view), and rises upward over the electric element 14, and passes through the notch 22A, then it is sucked in the refrigerant introduction pipe 92 from the upper portion of two thirds of the inlet 92A of the refrigerant introduction pipe 92. Oil which is dissolved in the refrigerant which is discharged through the intermediate discharge pipe 121 is separated from the refrigerant during the rising of the refrigerant in the hermetic shell case 12, and the separated oil is stuck to a wall surface of the shell case body 12A and flows from the plane portions 22C and the like into the oil reservoir 58. Further, the oil discharged through the oil discharge port 84A of the auxiliary discharge member 84 provided at the upper end of the rotary shaft 16 toward the space over the electric element 14 flows along the inner surface of the hermetic shell case 12 as shown by black arrows and flows into the oil reservoir 58 while lubricating the electric element 14.

The refrigerant (containing oil, described later) sucked in the refrigerant introduction pipe 92 passes through the interior thereof and also suction path, not shown, formed in the upper support member 54, and sucked into the low pressure chamber LR of the upper cylinder 38 through a suction port, not shown. What is sucked in the refrigerant introduction pipe 92 includes a part of oil which is discharged through the intermediate discharge pipe 121 and not separated from the refrigerant and also a part of oil discharged through the oil discharge port 84A of the auxiliary discharge member 84 provided at the upper end of the rotary shaft 16 as well as the refrigerant.

The intermediate pressure refrigerant sucked in the low pressure chamber LR of the upper cylinder 38 is subjected to compressions of second stage by the operation of the upper roller 46 and vane, not shown, and is changed into high temperature and high pressure refrigerant, which in turn passes from the high pressure chamber HR through the discharge port, not shown, and also passes through the noise eliminating chamber 62 formed in the upper support member 54 and the refrigerant discharge pipe 96, then it is discharged outside, and flows into a gas cooler, not shown.

The refrigerant discharged into the hermetic shell case 12 passes thorough the notch 22A and it is sucked in the second rotary compression element 34 through the inlet 92A of the refrigerant introduction pipe 92. At this time, although a part of oil which is discharged through the intermediate discharge pipe 121 and not separated from the refrigerant and also a part of oil discharged through the oil discharge port 84A of the auxiliary discharge member 84 provided at the upper end of the rotary shaft 16 as well as the refrigerant are sucked and flows into the second rotary compression element 34 through the inlet 92A of the refrigerant introduction pipe 92, but the oil separation capacity in the hermetic shell case 12 is improved compared with a case where the inlet 92A of the refrigerant introduction pipe 92 is opened to the interior of the hermetic shell case 12 under the electric element 14, as shown in the left side in FIG. 5 (respectively rotary compressor 200).

Particularly, since the inner diameter of the oil discharge port 84A is set at the size such that the electric element 14 inside the hermetic shell case 12 can be cooled and respective sliding portions are preferably lubricated, and the amount of oil sucked in the second rotary compression element 34 via the refrigerant introduction pipe 92 becomes a preferable amount, the amount of oil enters the second rotary compression element 34 and is discharged outside can be effectively reduced. As a result, the amount of oil entering the second rotary compression element 34 is adjusted to a preferable amount, thereby solving or restraining adverse affect exerted upon the refrigeration circuit while avoiding the lowering of the performance of the rotary compressor 10 in advance.

Figure 5:
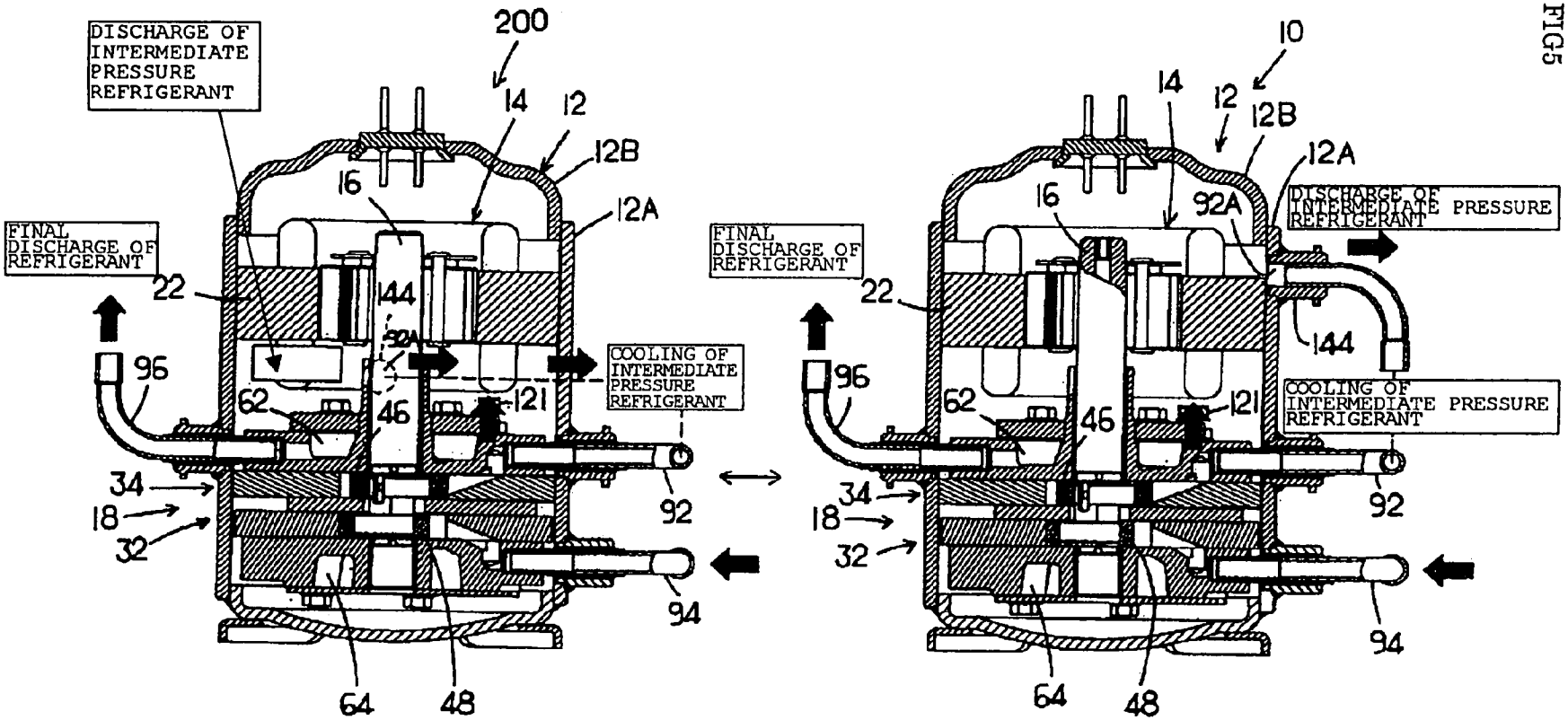
FIG. 5 are schematic longitudinal sectional views of the rotary compressors showing the comparison between a height of the rotary compressor in FIG. 1 and a height of the conventional rotary compressor provided with an inlet of a refrigerant introduction pipe under the electric element.

Since the refrigerant introduction pipe 92 is provided such that a part of the inlet 92A of the refrigerant introduction pipe 92 is positioned under the upper end of the stator 22 of the electric element 14, the height dimension of the rotary compressor 10 can be reduced, thereby restraining the height dimension of the rotary compressor 10 substantially the same to that shown in the right side in FIG. 5 compared with that of the conventional communication path 100 shown in the left side in FIG. 5. As a result, the rotary compressor 10 is very suitable for use in an automatic bending machine and a refrigerator which is small in accommodation space and limited in size of the compressor.

Meanwhile, according to the embodiment of the invention, the invention is applied to the two stage compression type rotary compressor 10, the invention is not limited thereto, but the invention is effective for the multistage compression type rotary compressor having more than two stages. Further, although the auxiliary discharge member 84 having the oil discharge port 84A is provided in the oil path 82 of the rotary shaft 16 as the adjusting means, the oil adjusting means is not limited thereto but the inner diameter of the oil discharge port 82A per se formed on the upper end of the rotary shaft 16 may be narrowed as the oil adjusting means.

The operation of the multistage_compression type rotary compressor shown in FIG. 6 is described next. The refrigerant discharged into the hermetic shell case 12 passes through the notch 22A and sucked in the second rotary compression element 34 through the inlet 92A of the refrigerant introduction pipe 92 in the same manner as that shown in FIG. 1. At this time, although a part of oil which is discharged through the intermediate discharge pipe 121 and not separated from the refrigerant and also a part of oil discharged through the oil discharge port 84A of the auxiliary discharge member 84 provided at the upper end of the rotary shaft 16 as well as the refrigerant are sucked and flow into the second rotary compression element 34 through the inlet 92A of the refrigerant introduction pipe 92, but the oil separation capacity in the hermetic shell case 12 is improved compared with a case where the inlet 92A of the refrigerant introduction pipe 92 is opened to the interior of the hermetic shell case 12 under the electric element 14.

Particularly, since the inner diameter of the oil discharge port 84A is set at the size such that the electric element 14 inside the hermetic shell case 12 can be cooled and respective sliding portions are preferably lubricated, and the amount of oil sucked in the second rotary compression element 34 via the refrigerant introduction pipe 92 becomes a preferable amount, the amount of oil entering the second rotary compression element 34 and discharged outside can be effectively reduced. As a result, the amount of oil entering the second rotary compression element 34 is adjusted to a preferable amount, thereby solving or restraining adverse affect exerted upon the refrigeration circuit while avoiding the lowering of the performance of the rotary compressor 10 in advance.

Figure 11:
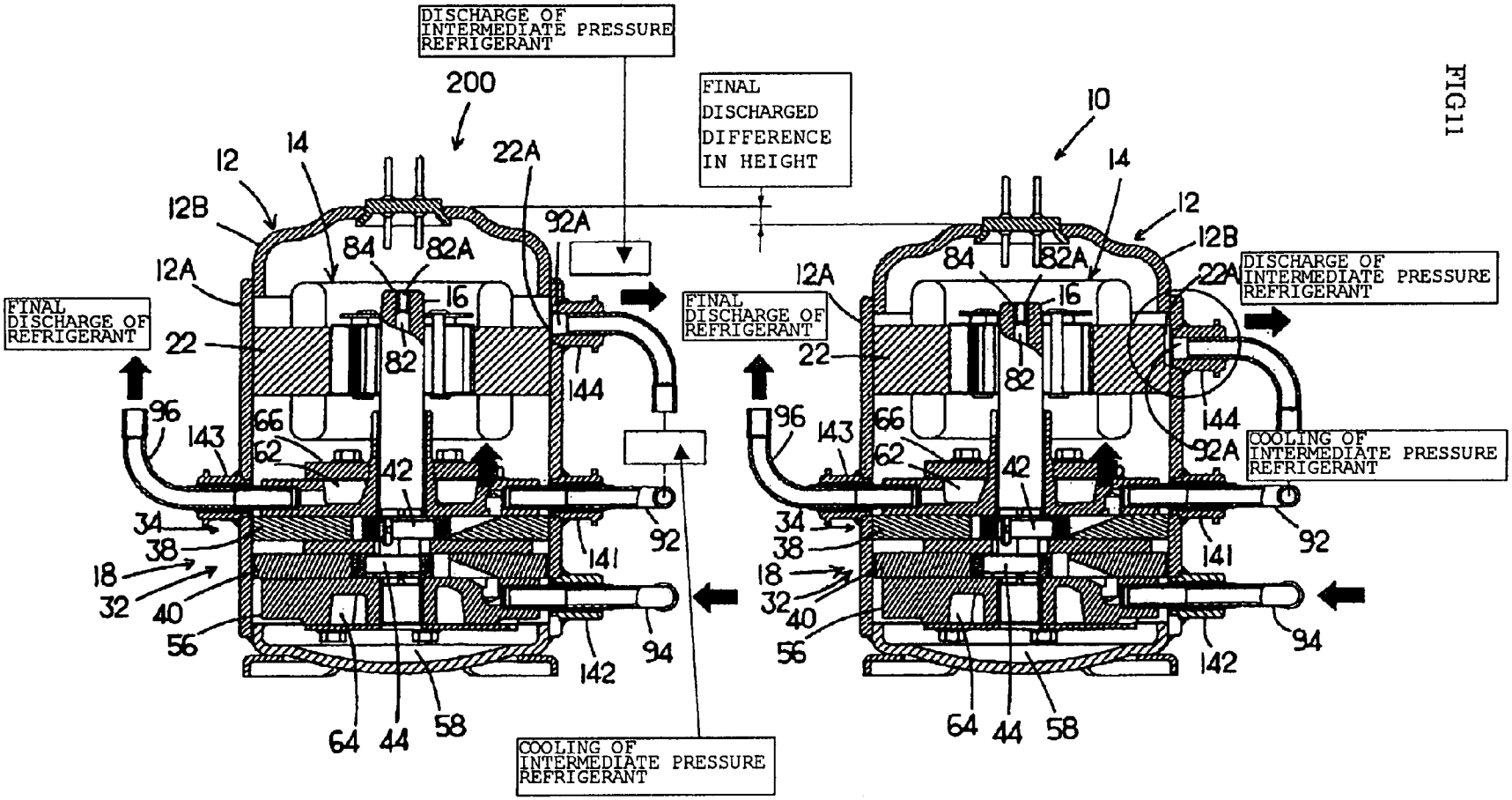
FIG. 11 are schematic longitudinal sectional views showing the comparison between a height of a rotary compressor in the case where a refrigerant introduction pipe is opened to the upper end of a stator of an electric element of a rotary compressor and a height of the rotary compressor of the modified embodiment of the invention.

A rotary compressor 200 in which the inlet 92A of the refrigerant introduction pipe 92 is opened to the upper end of the stator 22 is shown at the left side in FIG. 11, and the rotary compressor 10 of the invention is shown in the right side in FIG. 11. As is evident from FIG. 11, since the sleeve 144 for fixing the refrigerant introduction pipe 92 is lowered to the height of the electric element 14 according to the rotary compressor 10 of the invention, the height dimension of the compressor is significantly reduced compared with that shown at the left side in FIG. 11. As a result, the height dimension of the rotary compressor 10 can be significantly reduced, and hence the rotary compressor 10 is very suitable for use in an automatic bending machine and a refrigerator which is small in accommodation space and limited in size of the compressor.

Figure 9:
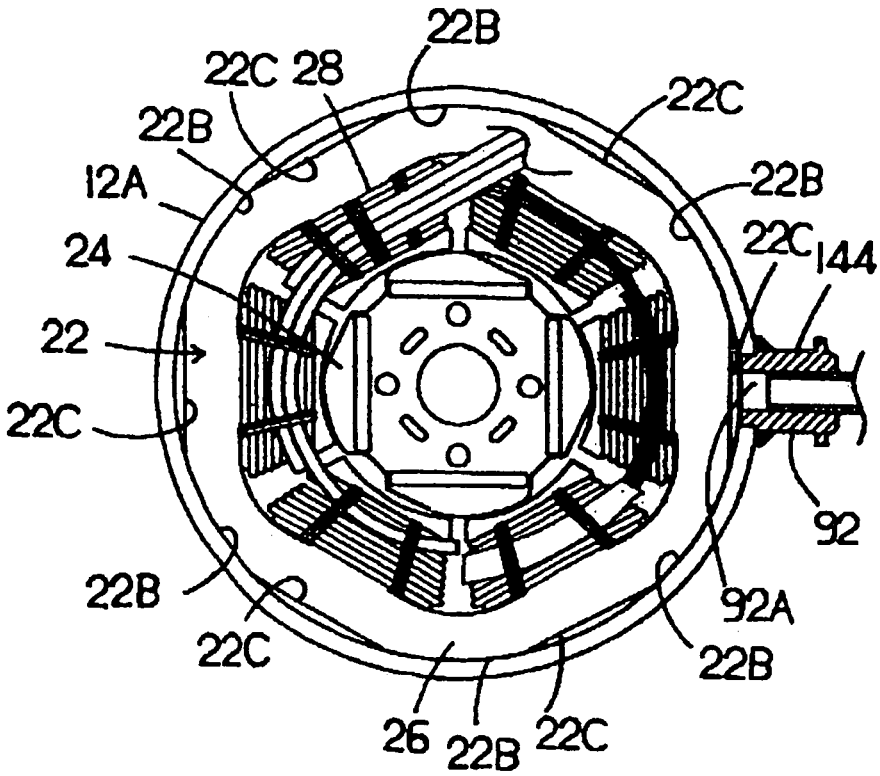
FIG. 9 is a longitudinal sectional plane view of an internal intermediate pressure multistage compression type rotary compressor according to a modified embodiment of the invention.
Figure 10:
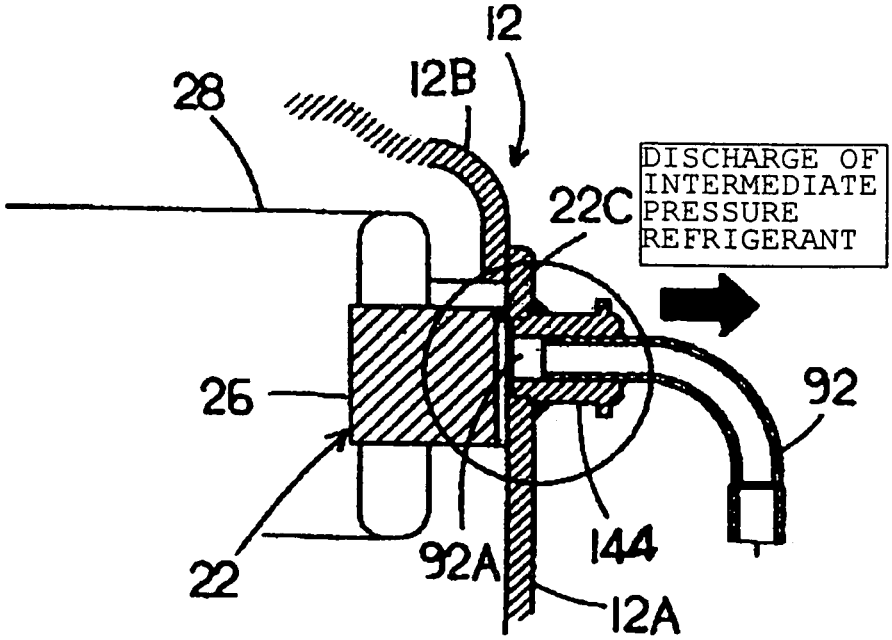
FIG. 10 is an enlarged sectional view showing a plane portion of a stator of the rotary compressor in FIG. 9.

The structure of the modified embodiment of the invention is shown in FIGS. 9 and 10. In this embodiment, a sleeve 144 is fixed to a shell case body 12A corresponding to a plane portions 22C formed on the side surface of a stator 22, and an inlet 92A of a refrigerant introduction pipe 92 is opened to the interior of the plane portions 22C. That is, the plane portions 22C fulfill a role of a notch of the invention. Meanwhile, it is assumed that the width of each plane portions 22C is the same as or slightly larger than the inlet 92A.

Even with such a structure, the height dimension of the rotary compressor 10 can be reduced in the same manner as set forth above. However, since the refrigerant in the hermetic shell case 12 under the electric element 14 can flow into the refrigerant introduction pipe 92, it is considered that the oil separation performance utilizing the space inside the hermetic shell case 12 is deteriorated in such a case that the refrigerant above the electric element 14 alone flows into the refrigerant introduction pipe 92. However, there is an advantage of the reduction of manufacturing cost of the stator 22, since it is not necessary to provide a particular notch 22A as set forth.

Figure 12:
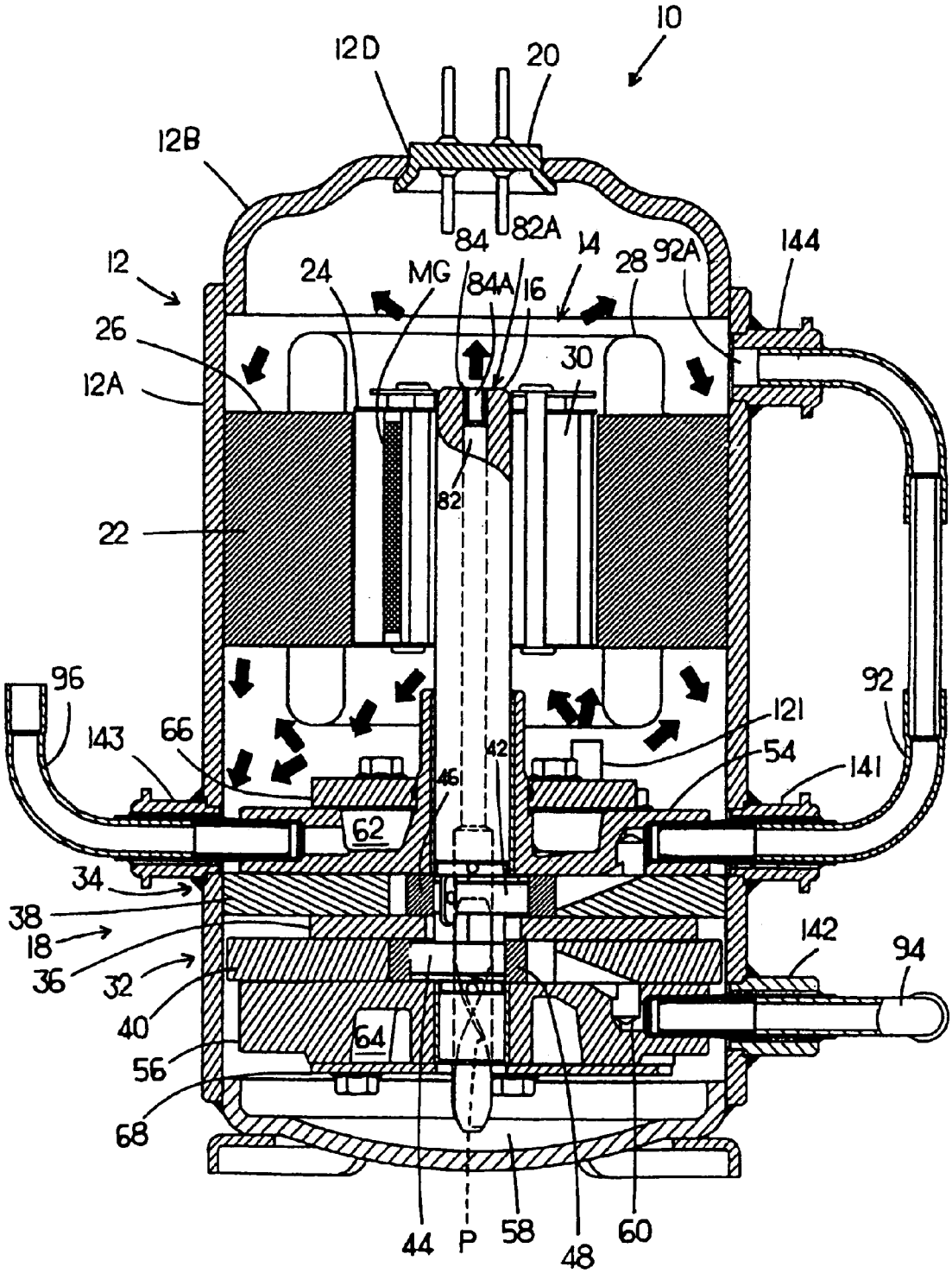
FIG. 12 is a longitudinal sectional side view of an internal intermediate pressure multistage compression type rotary compressor according to another modified embodiment of the invention.

The operation of the multistage compression type rotary compressor shown in FIG. 12 is described next. The intermediate pressure refrigerant sucked in the low pressure chamber of the upper cylinder 38 is subjected to compressions of second stage by the operation of the roller 46 and the vane (not shown) and is changed into high temperature and high pressure refrigerant, which in turn passes from the high pressure chamber through the discharge port, not shown, and also passes through the noise eliminating chamber 62 formed in the upper support member 54 and the refrigerant discharge pipe 96, then it is discharged outside, and flows into a gas cooler, not shown, in the same manner as that shown in FIG. 1.

What is sucked in the refrigerant introduction pipe 92 includes a part of oil which is discharged through the intermediate discharge pipe 121 and not separated from the refrigerant and also a part of oil discharged through the oil discharge port 84A of the auxiliary discharge member 84 provided at the upper end of the rotary shaft 16 as well as the refrigerant. The invention is structured such that the amount of discharge of oil is adjusted by changing the size of the oil discharge port 84A of the auxiliary discharge member 84.

The table 1 shows the inner diameter of the oil discharge port 84A, the amount of oil to be sucked in the second rotary compression element 34 and lubricating characteristics of the second rotary compression element 34 (the amount of oil at the second stage and lubricating characteristics at the second stage)

TABLE 1

| | Specification | Amount of oil at the second stage | lubricating characteristics |
|---|---|---|---|
| Testing Specification | Discharge of intermediate pressure refrigerant (under the electric element) Blocked off oil path: None | 15% | ○ |
| Testing Specification ① | Discharge of intermediate pressure refrigerant (under the electric element) Blocked off oil path: None | 10~15% | ○ |
| Testing Specification ② | Discharge of intermediate pressure refrigerant (under the electric element) Blocked off oil path: 4 mm diameter hole | 7~10% | ○ |
| Testing Specification ③ | Discharge of intermediate pressure refrigerant (under the electric element) Blocked off oil path: 2 mm diameter hole | 5% | ○ |

TABLE 1-continued

| | Specification | Amount of oil at the second stage | lubricating characteristics |
|---|---|---|---|
| Testing Specification ④ | Discharge of intermediate pressure refrigerant (under the electric element) Blocked off oil path: 1 mm diameter hole | 2% | Δ |

The amount of oil at the second stage in Table 1 shows an amount of oil which flows outside the hermetic shell case 12, is a ratio of the amount of circulation of oil in the refrigeration circuit and the amount of circulation refrigerant in the refrigeration circuit adding to the amount of circulation of oil. The test is performed under the same condition in respect of the amount of oil from the oil pumped up from the reservoir 58, oil viscosity, environment temperature, the capacity of rotary compressor 10, the number of revolutions of the electric element 14.

The column of the Testing Specification in this table shows cases where the intermediate pressure refrigerant in the hermetic shell case 12 is discharged under the electric element 14, and it is discharge from the space under the electric element 14 in the refrigerant introduction pipe 92 (the oil path 82 is not blocked off by the auxiliary discharge member 84), and the amount of oil in the second stage is large to the extent of 15%, which exhibits excellent lubricating characteristics.

Figure 13:
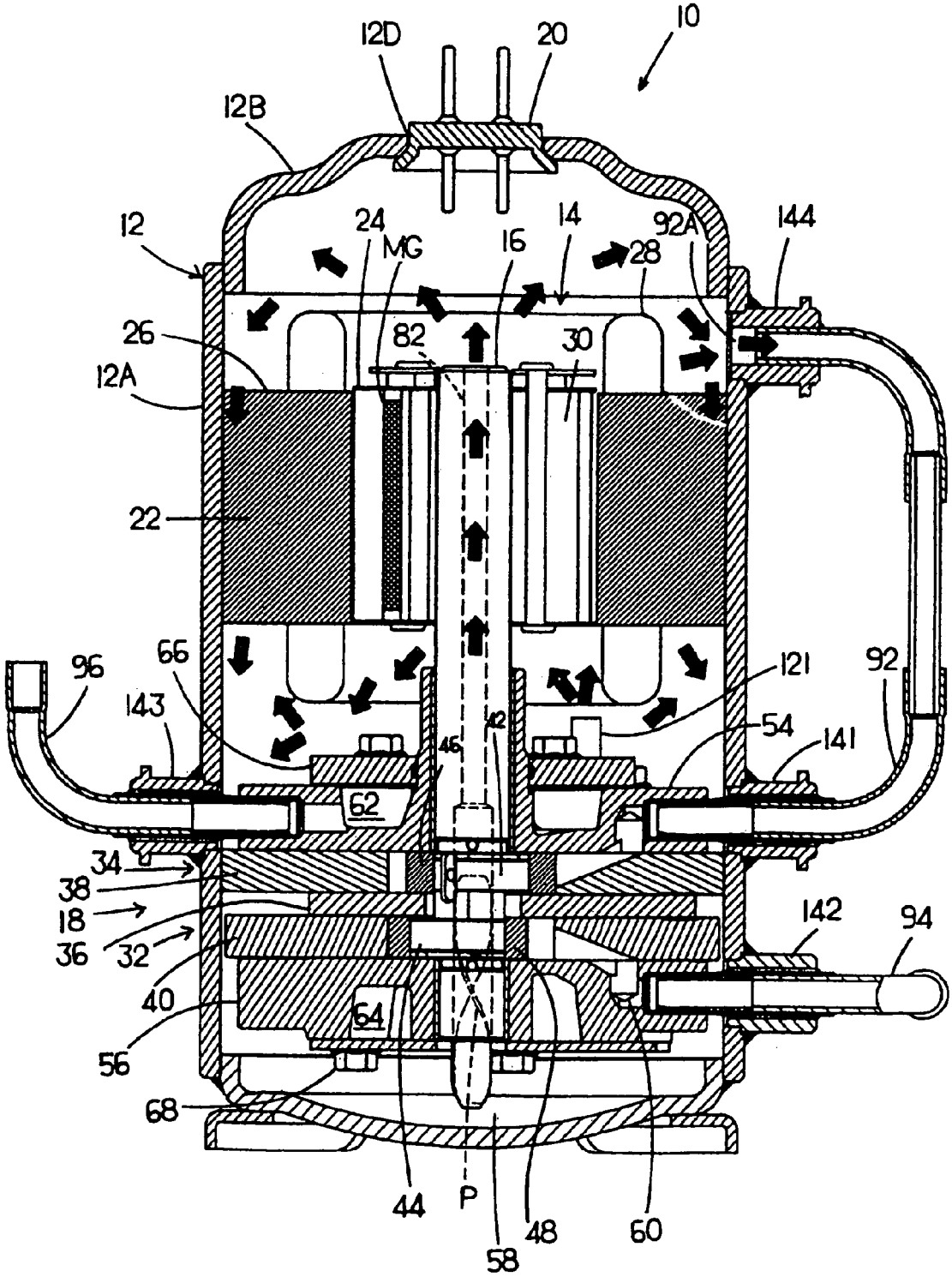
FIG. 13 is a longitudinal sectional side view of the internal intermediate pressure multistage compression type rotary compressor having a refrigerant introduction pipe connected to an electric element which is a contrast example used for explaining the invention of FIG. 12.

Testing Specification ① is the case, as shown in FIG. 13 where the intermediate pressure refrigerant is discharged under the electric element 14 of the hermetic shell case 12, and it is discharged from the space over the electric element 14 into the refrigerant introduction pipe 92, and the oil path 82 is not blocked off by the auxiliary discharge member 84. In this case, the amount of oil in the second stage is relatively large to the extent of 10 to 15%, which exhibits excellent lubricating characteristics.

Testing Specification ② is the case where the intermediate pressure refrigerant is discharged under the electric element 14 of the hermetic shell case 12, and it is discharged from the space over the electric element 14 into the refrigerant introduction pipe 92, and the oil discharge port 82A provided at the upper end of the oil path 82 is blocked off by the auxiliary discharge member 84, and the oil discharge port 84A of the auxiliary discharge member 84 is set at inner diameter of 4 mm. In this case, the amount of oil at the second stage is relatively small to the extent of 7 to 10%, which exhibits excellent lubricating characteristics.

Testing Specification ③ is the case where the intermediate pressure refrigerant is discharged under the electric element 14 of the hermetic shell case 12, and it is discharged from the space over the electric element 14 into the refrigerant introduction pipe 92, and the oil discharge port 82A of the oil path 82 is blocked off by the auxiliary discharge member 84, and the oil discharge port 84A of the auxiliary discharge member 84 is set at inner diameter of 2 mm. In this case, the amount of oil at the second stage is small to the extent of 5%, which exhibits excellent lubricating characteristics.

Testing Specification ④ is the case where the intermediate pressure refrigerant is discharged under the electric element 14 of the hermetic shell case 12, and it is discharged from the space over the electric element 14 into the refrigerant introduction pipe 92, and the oil discharge port 82A of the oil path 82 is blocked off by the auxiliary discharge member 84, and the oil discharge port 84A of the auxiliary discharge member 84 is set at inner diameter of 1 mm. In this case, the amount of oil in the second stage is significantly reduced to the extent of 2%, which exhibits not excellent lubricating characteristics.

It is found from the above results of the test that the circulation of oil in the second rotary compression element 34 can be secured while the amount of oil which flows out to the refrigeration circuit is reduced in the case where the inner diameter of the oil discharge port 84A of the auxiliary discharge member 84 is not less than 1.5 mm diameter and not more than 3 mm diameter. Accordingly, the oil discharge port 84A having the inner diameter of 2 mm of the Testing Specification ③ wherein the amount of oil is small to the extent of 5% with excellent lubricating characteristics is employed by this embodiment.

That is, since the auxiliary discharge member 84 of the Testing Specification ③ is provided in the oil discharge port 82A on the upper end of the oil path 82 for adjusting the amount of oil to be discharged into the upper space of the hermetic shell case 12, the oil pumped up by an oil pump P from the oil reservoir 58 passes through the oil path 82 of the rotary shaft 16 and it is discharged through the oil discharge port 84A into the upper space of the hermetic shell case 12 by a proper quantity. A part of the oil discharged into the hermetic shell case 12 flows downward toward the oil reservoir 58 while cooling and circulating the electric element 14 and the like, while the proper quantity of remaining oil flows from the space over the electric element 14 into the refrigerant introduction pipe 92, and the oil is sucked in the upper cylinder 38 of the second rotary compression element 34.

The oil discharge port 84A formed in the auxiliary discharge member 84 may be provided not only at one spot but also at plural spots. In the latter case, it is needless to say that a sectional area of a plurality of oil discharge ports in total is equal to the sectional area of the oil discharge port 84A of the present embodiment.

As explained above, the rotary compressor having no auxiliary discharge member 84 (shown in FIG. 13) on the oil discharge port 82A positioned at the upper end of the oil path 82 provided in the rotary shaft 16 so as to adjust the inner diameter of the oil discharge port 82A, the oil is discharged into the interior of the hermetic shell case 12 through the oil discharge port 82A positioned at the upper end of the oil path 82 (shown by black arrows), but the amount of oil discharged through the oil discharge port 82A is large, so that a large amount of oil discharged from the oil discharge port 82A is sucked into the interior of the refrigerant introduction pipe 92.

This oil is discharged outside the hermetic shell case 12 after it is compressed by the second rotary compression element 34, resulting in the deterioration of lubricating and sealing performance of the rotary compressor 10, thereby also affecting adversely in the refrigeration circuit. However, since the auxiliary discharge member 84 having the oil discharge port 84A for adjusting the inner diameter of the oil discharge port 82A is formed in the oil discharge port 82A of the oil path 82 provided in the rotary shaft 16, and the amount of oil to be discharged through the oil discharge port 84A is adjusted to a proper quality, the amount of oil sucked in the second rotary compression element 34 through the refrigerant introduction pipe 92 can be set at an optimum value.

Accordingly, lubrication in the second rotary compression element 34 can be optimized while reducing the amount of oil discharged outside from the second rotary compression element 34.

According to this embodiment, although the invention is applied to two stage compression type rotary compressor, the invention is not limited thereto but can be effectively applied to the multistage compression type rotary compressor having more than two stages. Further, although the auxiliary discharge member 84 having the oil discharge port 84A is provided in the oil path 82 of the rotary shaft 16 as the adjusting means, the oil adjusting means is not limited thereto but is provided by narrowing the inner diameter of the oil discharge port 82A per se formed at the upper end of the rotary shaft 16 as the adjusting means.

Still further, the operation of the multistage compression type rotary compressor shown in FIG. 14 is described next. In the same manner as the multistage compression type rotary compressor shown in FIG. 1, oil discharged into the upper space over of the electric element 14 through the oil discharge port 82A provided at the upper end of the rotary shaft 16 also moves upward toward in the hermetic shell case 12, and also flows downward into the oil reservoir 58 while cooling and lubricating the electric element 14, and a part of oil discharged into the upper space over the electric element 14 through the oil discharge port 82A passes through the refrigerant introduction pipe 92 and a suction path, not shown, formed in the upper support member 54, through the inlet 92A, then it is sucked in the low pressure chamber of the upper cylinder 38 through the suction port, not shown, formed in the upper support member 54.

Further, when the oil moves downward towards the hermetic shell case 12 and flows downward into the oil reservoir 58, a foreign matter remaining in the hermetic shell case 12 is accumulated in the oil reservoir 58. Since the oil reserved in the oil reservoir 58 is pumped up by the oil pump P and discharged, the oil discharged through the oil discharge port 82A on the upper end of the rotary shaft 16 is discharged together with the foreign matter accumulating in the oil reservoir 58 through the oil discharge port 82A on the upper end of the rotary shaft 16.

Although a part of oil discharged through the oil discharge port 82A or a foreign matter mixed in the oil enters the refrigerant introduction pipe 92 through the inlet 92A, the foreign matter such as dust or a cut waste which entered the refrigerant introduction pipe 92 through the inlet 92A is filtered by the filter 130 because the filter 130 is provided in the inlet 92A of the refrigerant introduction pipe 92, and hence only both oil having no foreign matter therein and the refrigerant are sucked in the low pressure chamber of the upper cylinder 38 through the suction port.

The intermediate pressure refrigerant sucked in the low pressure chamber of the upper cylinder 38 is subjected to compression of second stage by the operation of the upper roller 46 and the vane (not shown), and it is changed into high temperature and high pressure refrigerant, which in turn passes from the high pressure chamber through the suction port, not shown, then also passes through the discharge noise eliminating chamber 62 formed in the upper support member 54 and the refrigerant discharge pipe 96, and it is discharged outside, then it flows into a gas cooler, not shown, and the like.

The refrigerant in the gas cooler radiates heat, then it is depressurized by a pressure reducing device, not shown, subsequently it flows into an evaporator, not shown. The refrigerant in the evaporator is evaporated, then it passes through an accumulator and is sucked in the first rotary compression element 32 through the refrigerant introduction pipe 94, and this cycle is repeated.

Since the filter 130 is provided in the inlet 92A of the refrigerant introduction pipe 92 through which the refrigerant is introduced, a foreign matter such as dust and a cut waste which remains in the hermetic shell case 12 can be filtered by the filter 130. Accordingly, it is possible to prevent the occurrence of abrasion and locking in the rotary compression mechanism 18, thereby improving a reliability of the rotary compressor 10.

Figure 15:
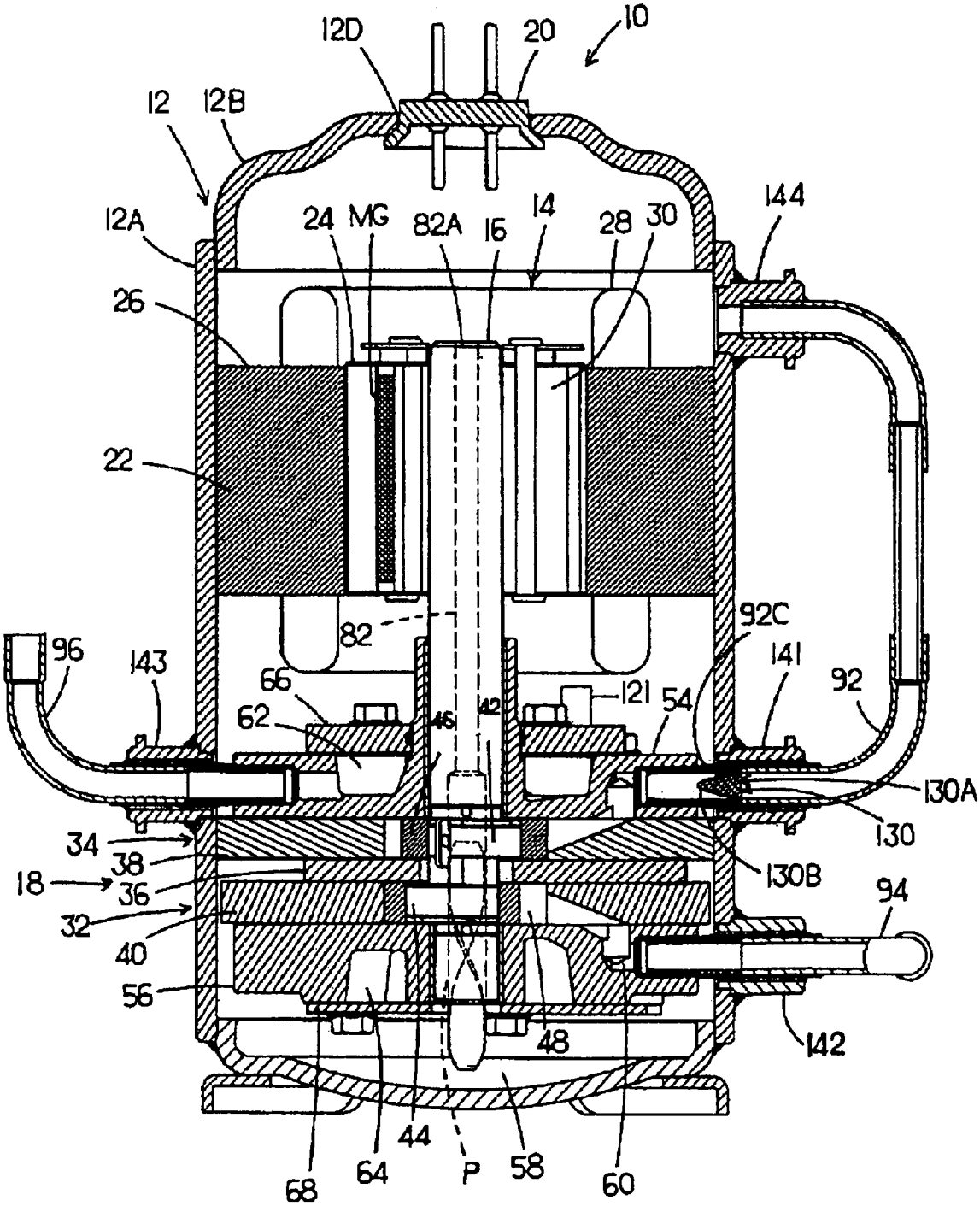
FIG. 15 is a longitudinal sectional side view of an internal intermediate pressure multistage compression type rotary compressor according to a still modified example of the invention.

Next, FIG. 15 shows a rotary compressor according to the third embodiment of the invention. In this embodiment, a filter 130 is provided in a sleeve 141 at the side of an outlet 92C of a refrigerant introduction pipe 92. The filter 130 is structured in the same manner as previous embodiment, and it is mounted in the outlet 92C of the refrigerant introduction pipe 92 while being brought into contact therewith in a state where an opening portion 130A is positioned at the upper stream side of the refrigerant and a tip end portion 130B is positioned at the downstream side of the refrigerant. As a result, the foreign matter such as dust and cut waste which is produced when the rotary compressor 10 is manufactured, and remains in the hermetic shell case 12 can be caught and filtered by the filter 130 before it is sucked in the second rotary compression element 34 through the refrigerant introduction pipe 92 in the same manner as the previous embodiments. Meanwhile, although the filter 130 is attached to the interior of the sleeve 144 in this example, it may be attached to the interior of the outlet 92C of the refrigerant introduction pipe 92 (the outlet side of the refrigerant introduction pipe 92 in the foregoing both cases).

Figure 16:
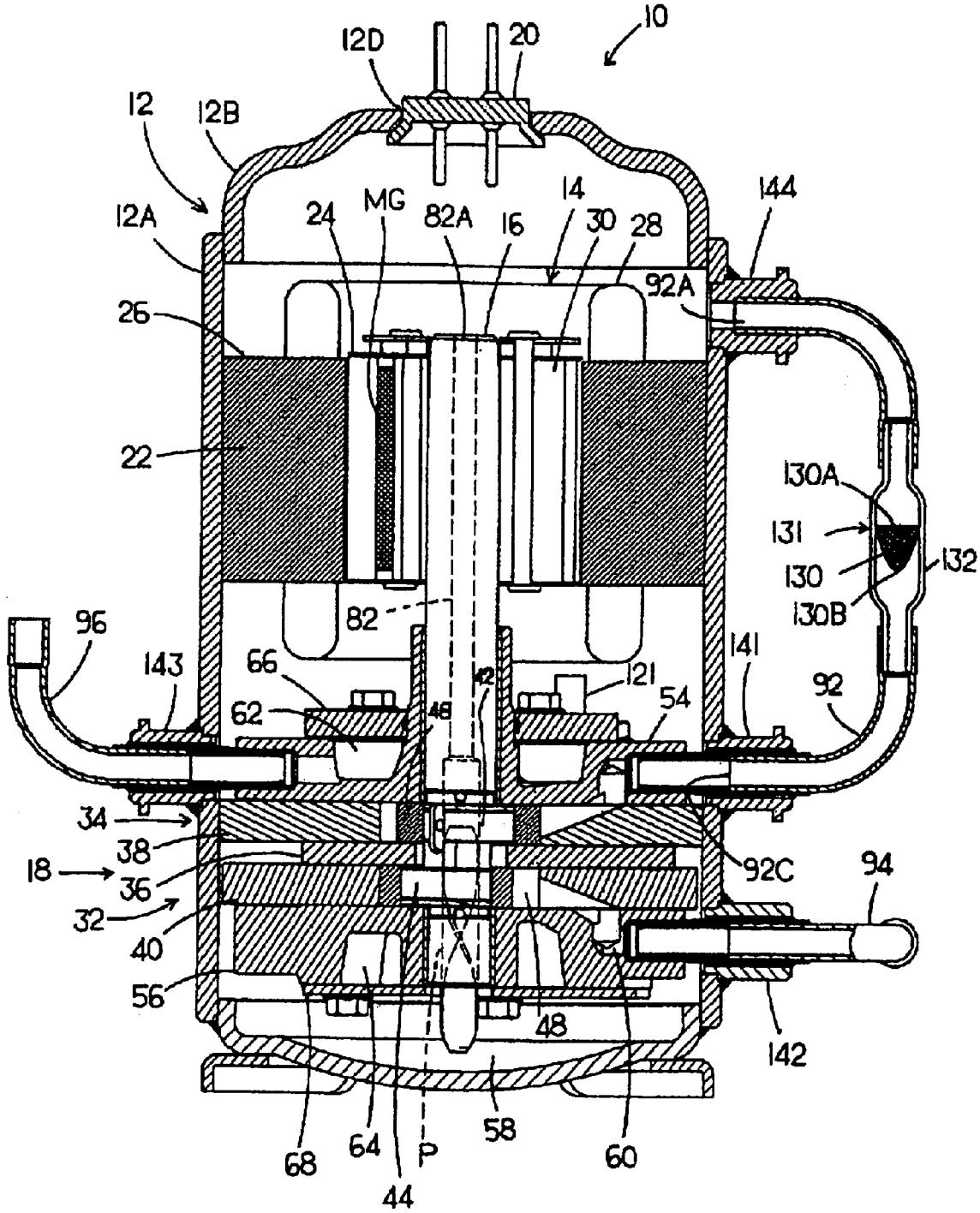
FIG. 16 is a longitudinal sectional side view of an internal intermediate pressure multistage compression type rotary compressor according to a fourth embodiment of the invention.

FIG. 16 shows an internal intermediate pressure multistage compression type rotary compressor according to the modified embodiment of the invention. In the third embodiment, a strainer 131 (filtering means) is attached between an inlet 92A of a refrigerant introduction pipe 92 and an outlet 92C of the refrigerant introduction pipe 92. The strainer 131 comprises a case 132 and a filter 130 attached to the interior of the case 132 in the same manner as the previous embodiments. The filter 130 is structured in the same manner as the previous embodiments wherein an opening portion 130A thereof is positioned at the upper stream side of refrigerant while a tip end portion 130B thereof is mounted in the case 132 while brought into contact with the interior thereof in a state where it is positioned at the downstream side of the refrigerant. With such a structure, since the filtering means is provided outside the hermetic shell case 12, assembling workability is improved. Even with such a structure, if a foreign matter such as dust_and a cut waste, which is produced when manufacturing the rotary compressor 10 in the same manner as the previous embodiments, and which remains in the hermetic shell case 12, enters the refrigerant introduction pipe 92, it can be caught and filtered by the filter 130. In this third embodiment, since the case 132 is thicker than the refrigerant introduction pipe 92 and the strainer 131 is provided in the case 132, the capacity for receiving a foreign matter to be filtered by the filter 130 provided in the inlet 92A of the inlet 92A of the refrigerant introduction pipe 92 and the outlet 92C thereof.

Although the invention is applied to the two stage compression type rotary compressor but it is effectively applied to the multistage compression type rotary compressor having more than two stages.

The operation of the internal intermediate pressure multistage compression type rotary compressor in FIG. 17 according to the fourth embodiment is described next. The refrigerant sucked in the low pressure chamber of the upper cylinder 38 is compressed by the operation of the upper roller 46 and the vane, not shown, in the same manner as that shown in FIG. 1, and it is changed into a high pressure (about 10 to 12 MPaG) refrigerant, which in turn discharged from the high pressure chamber of the upper cylinder 38 into the discharge noise eliminating chamber 62 through the discharge port, not shown. The refrigerant discharged into the discharge noise eliminating chamber 62 is discharged into the hermetic shell case 12 under the electric element 14 through the discharge port 120, and passes through the stator 22 of the electric element 14, the interior of the rotor 24, the distance therebetween and the distance between the stator 22 and the hermetic shell case 12, then it moves upward and finally reaches the space over the electric element 14. At this time, most of oil mixed in the refrigerant is separated from the refrigerant in the hermetic shell case 12 and flows downward along the inner surface of the hermetic shell case 12, and is reserved in the oil reservoir 58 provided at the bottom of the hermetic shell case 12. Meanwhile, the refrigerant is discharged into the refrigeration circuit outside the rotary compressor 10 through the refrigerant discharge pipe 96 which is opened to the space over of the electric element 14.

Since the refrigerant compressed by the second rotary compression element 34 is discharged into the hermetic shell case 12 and the high pressure refrigerant in the hermetic shell case 12 is discharged outside in such a manner, oil contained in the refrigerant discharged from the second rotary compression element 34 can be separated from the refrigerant in the hermetic shell case 12. Accordingly, the oil separation performance is improved and the amount of oil which flows out to the refrigeration circuit provided outside the rotary compressor 10 can be reduced, thereby restraining adverse affect exerted upon the refrigeration circuit. This is very advantageous in the case where the invention is applied to a cooling system (car air conditioner and the like) in which high pressure is reduced.

Further, since the interior of the hermetic shell case 12 becomes high pressure, the supply of oil to the first rotary compression element 32 is effected by the difference in pressure, and oil discharged from the first rotary compression element 32 is directly supplied to the second rotary compression element 34 together with the refrigerant, so that the supply of oil to the second rotary compression element 34 is effected without trouble.

Still further, oil is sufficiently contained the refrigerant which is sucked in the second rotary compression element 34, the increase of the temperature in the second rotary compression element 34 can be reduced. Accordingly, the increase of the temperature in the electric element 14 under high compression operation can be also prevented. As a result, the rotary compressor 10 having high performance and high reliability can be provided.

Particularly, since the refrigerant introduction pipe 92 for introducing the refrigerant discharged from the first rotary compression element 32 into the second rotary compression element 34 through the outside of the hermetic shell case 12 is provided, the temperature of the refrigerant to be sucked in the second rotary compression element 34 can be reduced, thereby enhancing the improvement of the compression efficiency and reliability of the rotary compressor 10.

The operation of the internal intermediate pressure multistage compression type rotary compressor of the fifth embodiment is described next. Since the back pressure chamber 52A for applying a back pressure to the vane 52 shown in FIG. 17 and the discharge noise eliminating chamber 64 of the first rotary compression element 32 are allowed to communicate with each other by the communication path 100, the intermediate pressure refrigerant which is compressed by the first rotary compression element 32 is supplied to the back pressure chamber 52A of the vane 52 of the first rotary compression element 32, which in turn urges the vane 52 against the lower roller 48.

Accordingly, the difference in pressure, i.e. between the pressure in the lower cylinder 40 of the first rotary compression element 32 and that in the back pressure chamber 52A, not shown, is reduced compared with a case where a high pressure is applied to the vane 52 of the first rotary compression element 32 as the back pressure, and hence the load applied to the tip end of the vane 52 can be reduced. As a result, a reliability of the rotary compressor 10 can be improved. Further, the refrigerant which leaks from the vane 52 of the first rotary compression element 32 to the interior of the lower cylinder 40 can be reduced, and hence it is possible to improve the compression efficiency.

Further, since the refrigerant compressed by the second rotary compression element 34 is discharged into the hermetic shell case 12 and the high pressure refrigerant in the hermetic shell case 12 is discharged outside, oil contained in the refrigerant discharged from the second rotary compression element 34 can be separated from the refrigerant in the hermetic shell case 12. Accordingly, oil separation performance is improved and the amount of oil flowing into the external refrigeration circuit outside the rotary compressor 10 can be reduced, thereby restraining adverse affect exerted upon an external refrigerating cycle This is very advantageous in the case where the invention is applied to a cooling system (car air conditioner and the like) in which_high pressure is reduced.

Still further, since the first and second rotary compression elements 32, 34 are disposed under the electric element 14 and the first rotary compression element 32 is disposed under the second rotary compression element 34, and also the refrigerant in the hermetic shell case 12 is discharged outside from the space over the electric element 14, the separation performance of oil from the high pressure refrigerant in the hermetic shell case 12 can be further improved. And also the structure of the invention is significantly effective in the case where carbon dioxide, which becomes high in the difference in pressure, i.e. between high and low pressures, is used as the refrigerant.

Although the invention is applied to the vertical type rotary compressor 10, the invention is not limited to the vertical type rotary compressor as set forth in the fourth, fifth and sixth embodiments of the invention, and the invention is effectively applied to a so-called lateral type multistage compression type rotary compressor in which the electric element 14 and the rotary compression mechanism 18 are disposed in parallel with each other at the left and right in the oblong hermetic shell case 12.

Still further, the operation of the multistage compression type rotary compressor shown in FIG. 18 is described next. The intermediate pressure refrigerant in the hermetic shell case 12 passes through the refrigerant introduction pipe 92 and also passes through the suction path, not shown, formed in the upper support member 54 and it is sucked in the low pressure chamber of the upper cylinder 38 through the suction port 161 in the same manner as that in FIG. 1. The thus sucked intermediate pressure refrigerant is subjected to compression of second stage by the upper roller 46 and the upper vane 50, and it is changed into the high temperature high pressure refrigerant. Accordingly, the discharge valve 127 provided in the discharge noise eliminating chamber 62 is opened so that the discharge noise eliminating chamber 62 and the discharge port 39 communicate with each other, and hence the refrigerant passes through the high pressure chamber of the upper cylinder 38 and discharge port 39, then it is discharged into the discharge noise eliminating chamber 62 formed in the upper support member 54.

Then, the high pressure refrigerant discharged into the discharge noise eliminating chamber 62 flows into the gas cooler 154 through the refrigerant discharge pipe 96. At this time, since the temperature of refrigerant is increased up to substantially +100° C., and such high temperature and high pressure refrigerant radiates heat through the gas cooler 154, thereby heating water in a hot water storage tank, not shown, to produce hot water of about +90° C.

The refrigerant per se is cooled in the gas cooler 154 and it flows out from the gas cooler 154. Then, the refrigerant is depressurized by the expansion valve 156, and then it enters the evaporator 157 where it is evaporated (at this time, heat is absorbed from the periphery), and it passes through an accumulator, not shown, and it is sucked in the first rotary compression element 32 through the refrigerant introduction pipe 94, and this cycle is repeated.

In the case where the multistage compression type rotary compressor to be used at a normal temperature is used at a cold district, the cylinder constituting the second rotary compression element 34 is expanded outward from the suction port 161 in the direction of rotation of the upper roller 46 to an extent of a predetermined angle to adjust an angle for starting compression by the second rotary compression element 34, so that the start of compression of the refrigerant in the upper cylinder 38 of the second rotary compression element 34 is delayed, thereby reducing displacement of the second rotary compression element 34.

As a result, since the displacement of the second rotary compression element 34 can be set at an optimum value without changing the components such as the upper cylinder 38 of the second rotary compression element 34, the upper roller 46, the eccentric portion 42 of the rotary shaft 16, the cost caused by the change of the components can be reduced.

Although the sixth embodiment is explained with reference to the multistage rotary compressor having the vertical type rotary shaft 16, it is needless to say that the invention can be applied to a multistage compression type rotary compressor having a lateral type rotary shaft.

Still further, although the multistage compression type rotary compressor of the embodiment is described with reference to the two stage compression type rotary compressor provided with the first and second rotary compression elements, the invention is not limited thereto, and it is needless to say that the invention can be applied to the multistage compression type rotary compressor provided with the third, the fourth and more stage rotary compression elements.

As described in detail, since the internal intermediate pressure multistage compression type rotary compressor comprising an electric element in a hermetic shell case, and first and second rotary compression elements being positioned under the electric element and driven by a rotary shaft of the electric element, wherein refrigerant compressed by said first rotary compression element is discharged into the hermetic shell case, and the discharged intermediate pressure refrigerant is compressed by said second rotary compression element, wherein it further comprises a refrigerant introduction pipe which is opened to the interior of the hermetic shell case over the electric element and introduces the refrigerant in the hermetic shell case into the second rotary compression element through an outside of the hermetic shell case, wherein a part of an inlet of the refrigerant introduction pipe is positioned under the upper end of a stator of the electric element, the amount of oil which is sucked in the refrigerant introduction pipe and is discharged outside from the second rotary compression element can be reduced compared with a case where the refrigerant introduction pipe is opened to the space under the electric element, so that the deterioration of lubricating and sealing performance in the rotary compressor and the occurrence of an adverse affect caused by the oil in the external refrigeration circuit can be effectively solved. Further, the attachment position of the refrigerant introduction pipe is lowered, the height dimension of the rotary compressor is reduced, for example, thereby providing the rotary compressor which is preferably adapted to an automatic vending machine and the refrigerator and the like which is small in accommodation space and limited in size of the rotary compressor.

What is claimed is:

1. An internal intermediate pressure multistage compression type rotary compressor comprising an electric element in a hermetic shell case, and first and second rotary compression elements being positioned under the electric element and driven by a rotary shaft of the electric element, wherein refrigerant compressed by said first rotary compression element is discharged into the hermetic shell case, and the discharged intermediate pressure refrigerant is compressed by said second rotary compression element, said multistage compression type rotary compressor further comprising:

a plurality of sleeves including at least a first sleeve and a second sleeve, the first sleeve being fixed to a side surface of the hermetic shell case at an upper end of a stator of the electric element, the second sleeve being fixed to a side surface of the hermetic shell case at a position below the upper end of the stator of the electric element; and a refrigerant introduction pipe which is opened to the interior of the hermetic shell case over the electric element and introduces the refrigerant in the hermetic shell case into the second rotary compression element through an outside of the hermetic shell case, wherein an inlet of one end of the refrigerant introduction pipe is inserted into and connected to the first sleeve, wherein another end of the refrigerant pipe is inserted into and connected to the second sleeve, wherein a part of the inlet inside the first sleeve is positioned under the upper end of the stator of the electric element and another part of the inlet inside the first sleeve is positioned over the upper end of the stator.

2. An internal intermediate pressure multistage compression type rotary compressor comprising an electric element in a hermetic shell case, and first and second rotary compression elements being positioned under the electric element and driven by a rotary shaft of the electric element, wherein refrigerant compressed by said first rotary compression element is discharged into the hermetic shell case, and the discharged intermediate pressure refrigerant is compressed by said second rotary compression element, and said multistage compression type rotary compressor further comprising a refrigerant introduction pipe for introducing the refrigerant in the hermetic shell case over the electric element into the second rotary compression element through an outside of the hermetic shell case, and plural notches are formed on side surface of a stator of the electric element and extended through on the stator at longitudinal direction and at least either one of an upper side or a lower side of the notch communicates with an interior of a hermetic shell case, wherein an inlet of the refrigerant introduction pipe is positioned to communicate directly with an interior of at least one of the notches, wherein the at least one of the notches has a length from an upper end to a lower end substantially the same or slightly greater than the inlet of the refrigerant introduction pipe.

* * * * *